US011577925B2

(12) United States Patent
Shiota

(10) Patent No.: US 11,577,925 B2
(45) Date of Patent: Feb. 14, 2023

(54) MEDIUM FEEDING DEVICE, IMAGE READING DEVICE, AND MEDIUM FEEDING METHOD

(71) Applicant: SEIKO EPSON CORPORATION, Tokyo (JP)

(72) Inventor: Takayuki Shiota, Kitakyushu (JP)

(73) Assignee: SEIKO EPSON CORPORATION, Tokyo (JP)

( * ) Notice: Subject to any disclaimer, the term of this patent is extended or adjusted under 35 U.S.C. 154(b) by 108 days.

(21) Appl. No.: 17/241,250

(22) Filed: Apr. 27, 2021

(65) Prior Publication Data

US 2021/0331884 A1 Oct. 28, 2021

(30) Foreign Application Priority Data

Apr. 28, 2020 (JP) ..... JP2020-079439

(51) Int. Cl.

| | |
|---|---|
| ***B65H 7/18*** | (2006.01) |
| ***B65H 3/06*** | (2006.01) |
| ***B65H 7/14*** | (2006.01) |
| ***B65H 7/04*** | (2006.01) |

(52) U.S. Cl.

CPC ..... *B65H 7/18* (2013.01); *B65H 3/063* (2013.01); *B65H 3/0669* (2013.01); *B65H 7/04* (2013.01); *B65H 7/14* (2013.01); *B65H 2301/42322* (2013.01); *B65H 2511/13* (2013.01); *B65H 2511/15* (2013.01); *B65H 2511/22* (2013.01); *B65H 2557/2423* (2013.01)

(58) Field of Classification Search

CPC ..... B65H 1/06; B65H 3/063; B65H 3/0661; B65H 7/04; B65H 7/14; B65H 7/18; B65H 2301/42322; B65H 2511/13; B65H 2511/15; B65H 2511/22; B65H 2557/2423

See application file for complete search history.

(56) References Cited

U.S. PATENT DOCUMENTS

| | | | | |
|---|---|---|---|---|
| 2007/0114716 | A1 | 5/2007 | Morikawa et al. | |
| 2017/0359475 | A1 | 12/2017 | Xie et al. | |
| 2018/0215564 | A1* | 8/2018 | Matsumura | B65H 3/0684 |
| 2020/0198908 | A1* | 6/2020 | Shimosaka | B65H 1/06 |
| 2021/0253387 | A1* | 8/2021 | Funaki | B65H 3/06 |
| 2022/0033210 | A1* | 2/2022 | Sakai | B65H 7/06 |

FOREIGN PATENT DOCUMENTS

| | | | |
|---|---|---|---|
| JP | H0558512 | A | 3/1993 |
| JP | 2004182449 | A | 7/2004 |
| JP | 2007137655 | A | 6/2007 |
| JP | 2008230759 | A | 10/2008 |
| JP | 2010202296 | A | 9/2010 |
| JP | 2012012169 | A | 1/2012 |
| JP | 2016169104 | A | 9/2016 |
| JP | 2018065691 | A | 4/2018 |
| JP | 2018122948 | A | 8/2018 |
| WO | 2020188817 | A1 | 9/2020 |

* cited by examiner

*Primary Examiner* — Prasad V Gokhale

(74) *Attorney, Agent, or Firm* — Chip Law Group

(57) ABSTRACT

A document feeding device includes a document placement unit at which a document is placed, a feeding roller for feeding the document, and a ranging sensor for measuring a distance to the document located most upward on the document placement unit. A control unit stops feeding the document by the feeding roller based on post-processing distance data obtained by statistically processing time series data of the distance measured by the ranging sensor.

11 Claims, 15 Drawing Sheets

MEDIUM FEEDING DEVICE, IMAGE READING DEVICE, AND MEDIUM FEEDING METHOD

The present application is based on, and claims priority from JP Application Serial Number 2020-079439, filed Apr. 28, 2020, the disclosure of which is hereby incorporated by reference herein in its entirety.

BACKGROUND

1. Technical Field

The present disclosure relates to a medium feeding device, an image reading device, and a medium feeding method.

2. Related Art

A sheet feeding device of JP-A-2018-122948 includes a moving unit that is capable of following movement in a thickness direction of an uppermost document loaded on a document tray, and a ranging unit configured to detect a position of the moving unit. The ranging unit monitors a distance to the moving unit at a predetermined time interval. In a state where the moving unit abutting the surface of the uppermost document, a pickup roller starts feeding the document. Then, when a detection result of the ranging unit during the document feeding exceeds a determination reference value, it is determined that the transport abnormality has occurred, and the feeding of the document by the pickup roller is stopped.

In the configuration of JP-A-2018-122948, the distance to the moving unit is monitored at the predetermined time interval, however, whether the document can be fed is determined based on a measurement result of the position of the moving unit at one measuring time point. Therefore, due to an error factor that occurs accidentally at the foregoing measuring time point, there is a possibility of erroneously determining that a transport abnormality has occurred even though no transport abnormality has actually occurred. As a result, there is a possibility of stopping feeding of the document even though the feeding of the document does not need to be stopped.

SUMMARY

A medium feeding device according to the present disclosure for solving the above-described problems includes a placement unit at which media are placed, a feeding unit configured to feed the media placed at the placement unit, a measuring unit configured to measure a distance to the medium located most upward in a placement direction among the media placed at the placement unit, and a control unit configured to receive a detection signal output from the measuring unit, and control the feeding of the medium by the feeding unit, wherein the control unit is configured to perform determination processing on whether to stop feeding the medium by the feeding unit based on post-processing distance data obtained by statistically processing time series data of the distance.

A medium feeding method according to the present disclosure for solving the above-described problems is a medium feeding method for a medium feeding device including a placement unit at which media are placed, a feeding unit configured to feed, one by one, a plurality of the media placed at the placement unit, and a measuring unit configured to measure a distance to the medium located most upward in a placement direction among the media placed at the placement unit, wherein the method includes the steps of obtaining post-treatment distance data by statistically processing time series data of the distance, and determining whether to stop feeding the medium by the feeding unit based on the post-processing distance data.

DESCRIPTION OF EXEMPLARY EMBODIMENTS

Figure 1:
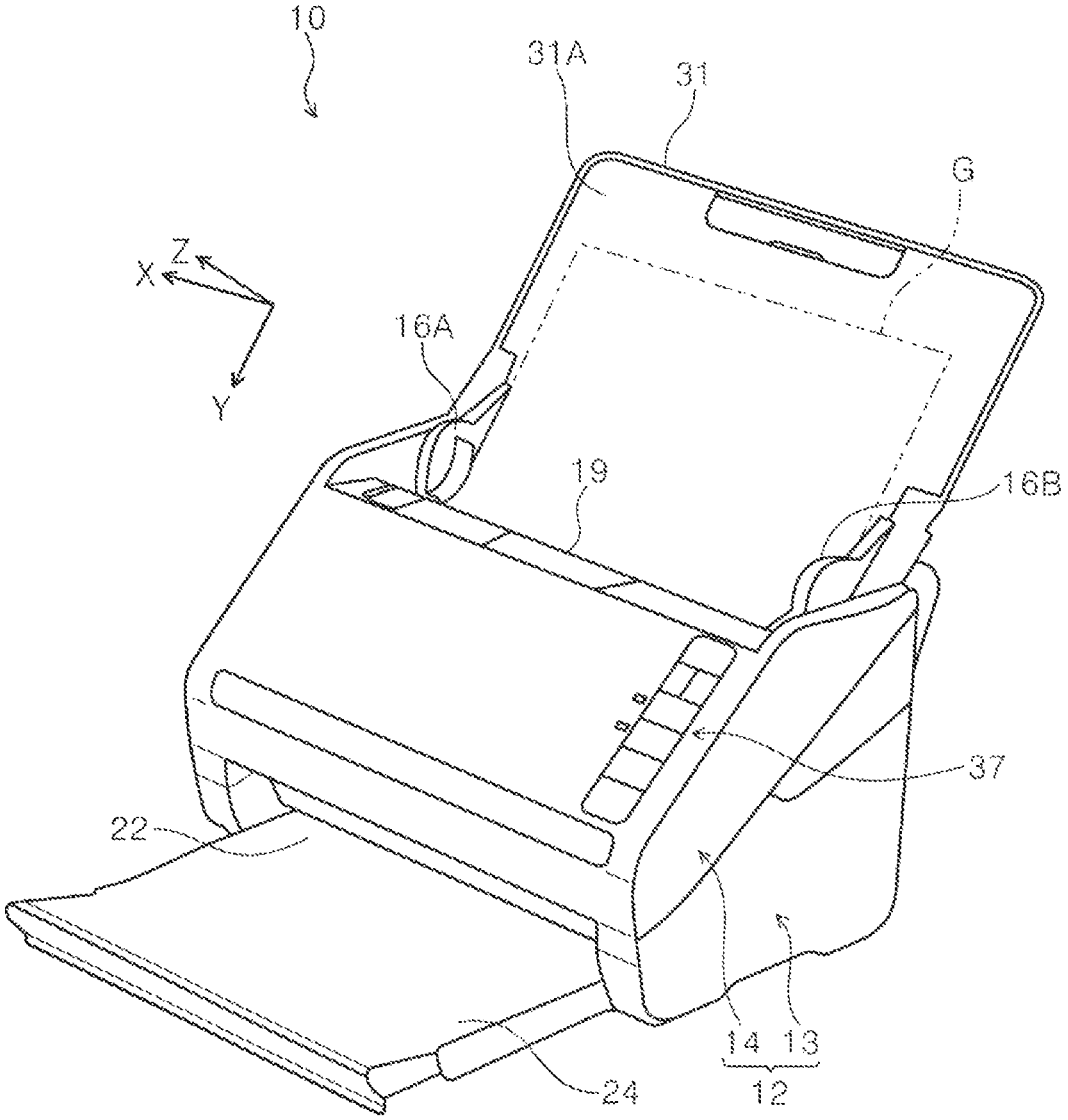
FIG. 1 is a perspective view illustrating an appearance of a scanner according to a first exemplary embodiment.

Hereinafter, the present disclosure will be schematically described.

A medium feeding device according to a first aspect includes a placement unit at which media are placed, a feeding unit configured to feed the media placed on the placement unit, a measuring unit configured to measure a distance to the medium located most upward in a placement direction among the media placed on the placement unit, and a control unit configured to receive a detection signal output from the measuring unit, and control the feeding of the medium by the feeding unit, wherein the control unit is configured to perform determination processing on whether to stop feeding the medium by the feeding unit based on post-processing distance data obtained by statistically processing time series data of the distance.

According to the present aspect, the control unit is configured to perform determination processing on whether to stop feeding the medium by the feeding unit based on the post-processing distance data obtained by statistically processing the time series data of the distance, so that it is less likely to be affected by an error factor that occurs accidentally as compared to a configuration in which the feeding of the medium is stopped based on the distance data at one time point. As a result, an erroneous determination is less likely to occur, and in addition, the possibility of stopping feeding can be suppressed even though the feeding of the medium does not need to be stopped.

A medium feeding device according to a second aspect is the medium feeding device according to the first aspect, wherein the measuring unit is located upward in the placement direction with respect to the placement unit.

According to the present aspect, compared to a configuration in which the measuring unit is not located upward in the placement direction, a distance between the medium placed on the placement unit and the measuring unit is reduced. Therefore, a decrease in measuring accuracy of the distance measured by the measuring unit can be suppressed.

A medium feeding device according to a third aspect is the medium feeding device according to the first aspect or the second aspect, wherein the measuring unit is arranged on one side and the other side of the feeding unit in a width direction of the medium when viewed from the placement direction.

According to the present aspect, even in a case where one portion of the medium in the width direction and the other portion of the medium are in different deformation states when the medium is fed, the variation in the deformation states is measured in one side measuring unit and the other side measuring unit. Therefore, the feeding state of the medium can be measured accurately.

A medium feeding device according to a fourth aspect is the medium feeding device according to any one of the first to third aspects, wherein the measuring unit is arranged downstream from the center of the placement unit in a feeding direction of the medium when viewed from the placement direction.

According to the present aspect, the measuring unit performs measurement at a location near the feeding unit, where the deformation state of the medium is relatively significant. Therefore, the feeding of the medium can be stopped at an earlier time point as compared to a case where the measurement is performed at a location remote from the feeding unit.

A medium feeding device according to a fifth aspect is the medium feeding device according to any one of the first to fourth aspects, wherein the post-processing distance data includes first data that is a moving average value of the time series data, and second data that is a moving average value of the time series data over a longer period of time than the first data, and when the first data deviates from an acceptable range obtained by adding a threshold value to the second data, the control unit is configured to stop feeding the medium by the feeding unit.

According to the present aspect, the second data is a moving average value over a longer period of time than the first data, whereby it is less likely to be affected by an error factor that occurs accidentally than the first data. Conversely, the first data is a moving average value over a shorter period than the second data, whereby the sensitivity is higher than that of the first data with respect to the actually generated feeding abnormality. By comparing the first data and the second data in this manner to determine the feeding abnormality, the feeding abnormality can be determined accurately.

A medium feeding device according to a sixth aspect is the medium feeding device according to any one of the first to fifth aspects, wherein a total thickness measuring unit is provided, the total thickness measuring unit configured to measure a total thickness of the media prior to the feeding placed on the placement unit, the feeding unit is configured to feed the medium located most downward among a plurality of the media placed on the placement unit, and the control unit is configured to make the threshold value when the total thickness of the media is at a first thickness smaller than the threshold value when the total thickness of the media is at a second thickness that is thinner than the first thickness.

In a case that the feeding unit is configured to feed the medium located most downward, the medium to be fed is held down by the medium to be loaded thereon. Thus, the larger the number of media loaded in the placement unit, i.e., the thicker the total thickness of the media, the less likely it is to discover the feeding abnormality.

Accordingly, in the present aspect, the threshold value when the total thickness of the media is at a first thickness is smaller than the threshold value when the total thickness of the media is at a second thickness that is thinner than the first thickness. In other words, the sensitivity of abnormal discovery is increased in situations where it is difficult to discover the feeding abnormality. As a result, the feeding abnormality can be determined appropriately.

A medium feeding device according to a seventh aspect is the medium feeding device according to any one of the first to sixth aspects, wherein an operation detecting unit is provided, the operation detecting unit being configured to detect additional operation for adding a medium onto the medium placed on the placement unit, and when the control unit determines that the additional operation is performed or the additional operation is possibly performed based on the detection signal of the operation detecting unit, the control unit continues to feed the medium regardless of a result of the measurement by the measuring unit.

In a case that the feeding unit is configured to feed the medium located most downward, it can be said that the configuration makes it easy for a user to perform the additional operation to add a medium onto the medium placed on the placement unit, in other words, a joint operation of the medium. Addition of the other medium onto the medium fed in such a manner would be an error factor in the measurement of the distance.

Here, according to the present aspect, when the control unit determines that the additional operation is performed or the additional operation is possibly performed based on the detection signal of the operation detecting unit, the control unit continues to feed the medium regardless of a result of the measurement by the measuring unit. This can suppress the accidental stop of the feeding of the medium due to the erroneous measurement of the fluctuation in the distance caused by the additional operation as the deformation of the medium.

A medium feeding device according to a eighth aspect is the medium feeding device according to any one of the first to seventh aspects, wherein a medium detecting unit is provided to the placement unit, the medium detecting unit being configured to detect the presence or absence of the medium, and the control unit is configured to, upon detecting the medium by the medium detecting unit from a state in which there is no medium on the placement unit, execute an automatic feeding mode for automatically starting the feeding of the medium by the feeding unit, and the control unit is configured to, during the execution of the automatic feeding mode, obtain the post-processing distance data by statistically processing the time series data of the distance after the feeding unit starts feeding the medium. In the automatic feeding mode, the distance before the start of feeding the medium fluctuates greatly. Thus, when the distance in such a state is used to determine the feeding abnormality, the determination of the feeding abnormality cannot be performed correctly. Therefore, in the present aspect, the control unit is configured to, during the execution of the automatic feeding mode, obtain the post-processing distance data by statistically processing the time series data of the distance after the feeding unit starts feeding the medium, whereby the determination of the feeding abnormality can be performed more correctly.

A medium feeding device according to a ninth aspect is the medium feeding device according to any one of the first to seventh aspects, wherein a medium detecting unit is provided to the placement unit, the medium detecting unit being configured to detect the presence or absence of the medium, and the control unit is configured to obtain the post-processing distance data by statistically processing the time series data of the distance after the medium detecting unit detects the medium.

According to the present aspect, the measurement result at the measuring unit when the medium is not placed on the placement unit is prevented from being used in the determination of the stop of the feeding of the medium, whereby the determination of the feeding abnormality can be performed more correctly.

An image reading device according to a tenth aspect includes a reading unit configured to read a medium, and the medium feeding device according to any one of the first to ninth aspects, which is configured to feed the medium toward the reading unit.

According to the present aspect, the action and effect of any one of the first to ninth aspects described above is obtained in the image reading device.

A medium feeding method according to a eleventh aspect is a medium feeding method for a medium feeding device comprising a placement unit at which media are placed, a feeding unit configured to feed, one by one, a plurality of the media placed on the placement unit, and a measuring unit configured to measure a distance to the medium located most upward in a placement unit among the media placed on the placement unit, wherein the method includes the steps of obtaining post-treatment distance data by statistically processing time series data of the distance, and determining whether to stop feeding the medium by the feeding unit based on the post-processing distance data.

According to the present aspect, the determination processing on whether to stop feeding the medium by the feeding unit is performed based on the post-processing distance data obtained by statistically processing the time series data of the distance, so that it is less likely to be affected by an error factor that occurs accidentally as compared to a configuration in which the feeding of the medium is stopped based on the distance data at one time point. As a result, an erroneous determination is less likely to occur, and in addition, the possibility of stopping feeding can be suppressed even though the feeding of the medium does not need to be stopped.

First Exemplary Embodiment

Hereinafter, a first exemplary embodiment of a medium feeding device, an image reading device, and a medium feeding method according to the present disclosure will be described with reference to the accompanying drawings.

FIG. 1 illustrates a scanner 10 as an example of the image reading device. The scanner 10 is configured to be readable on at least one surface of a front surface and a back surface of a document G as an example of a medium.

Note that the X-Y-Z coordinate system illustrated in each drawings is an orthogonal coordinate system. The X direction is a device width direction and is a document width direction that intersects with a transport direction of the document G. The Y direction is a document transport direction. Note that the Y direction is inclined in a direction intersecting the horizontal plane and the vertical plane, which are not illustrated. The Z direction is a direction orthogonal to the Y direction and is a direction orthogonal to the plane of the document G. Additionally, the Z direction is inclined in a direction intersecting the horizontal plane and the vertical plane.

The downstream in the feeding direction and the transport direction of the document G is the +Y direction, and the upstream in the transport direction is the −Y direction.

The scanner 10 includes a device main body 12, a reading unit 20 (FIG. 2) configured to read the document G, and a document feeding device 30 (FIG. 2) for feeding the document G toward the reading unit 20.

The device main body 12 includes a lower unit 13 and an upper unit 14. The upper unit 14 is provided so as to be openable and closable by rotating with respect to the lower unit 13 about a hinge portion (not illustrated). The upper unit 14 is opened in a front direction of the device, and the interior thereof is revealed, which allows for jam processing of the document.

A document placement unit 31, which will be described later, is provided on the back of the device main body 12.

An operating panel 37, which will be described later, is provided on a front surface of the upper unit 14. A feeding port 19 that interfaces with the interior of the device main body 12 is formed at an upper portion of the upper unit 14. The document G placed on the document placement unit 31 is fed toward the reading unit 20 by the document feeding device 30, which will be described later. The document G, which has been read in the reading unit 20, is ejected from an ejection port 22 in a lower portion of the upper unit 14 toward a paper ejection tray 24.

Figure 2:
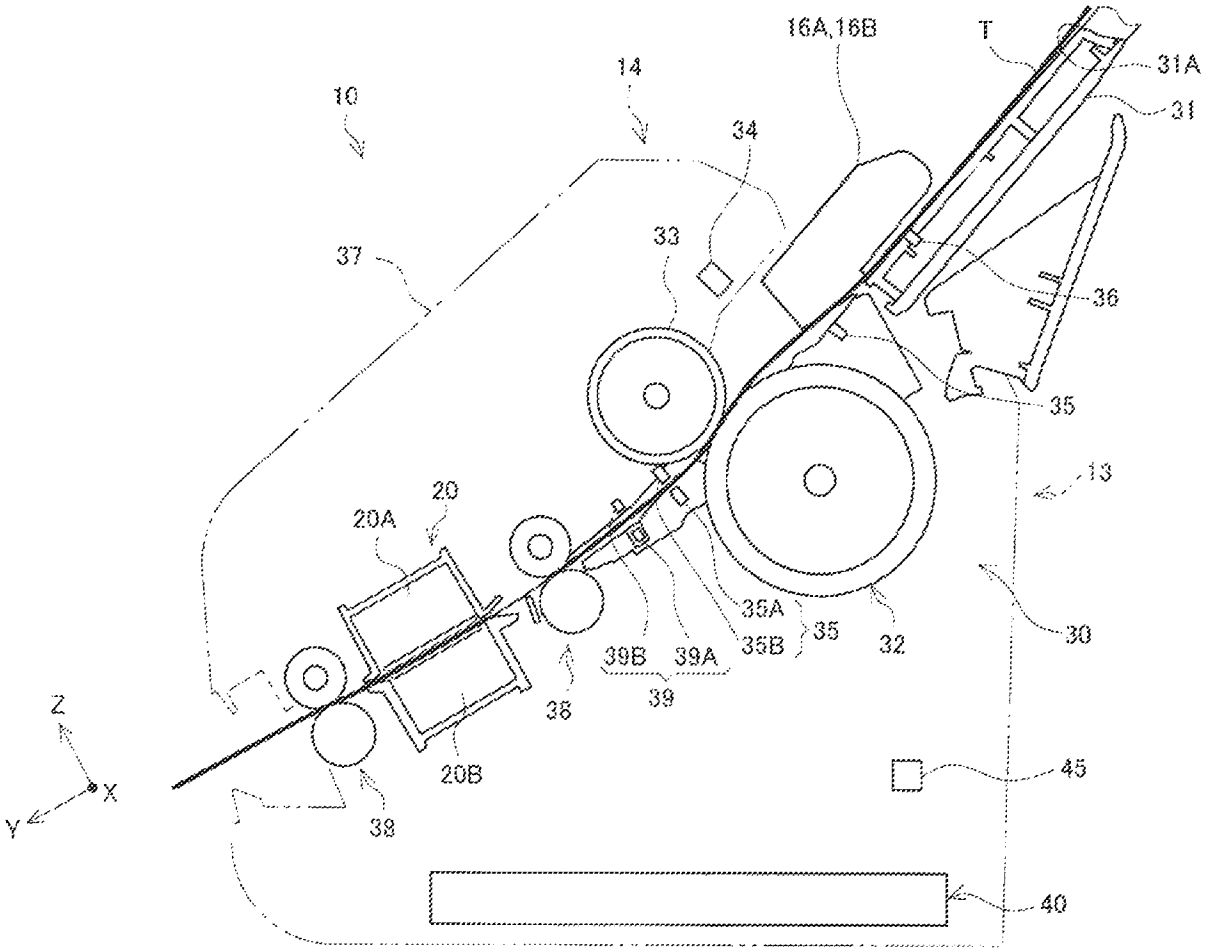
FIG. 2 is a vertical cross-sectional view of a document transport path of the scanner according to the first exemplary embodiment.

As illustrated in FIG. 2, the reading unit 20 includes an upper reading sensor 20A provided in the upper unit 14 and a lower reading sensor 20B provided in the lower unit 13. The upper reading sensor 20A and the lower reading sensor 20B are configured as a close contact image sensor module (CISM) as an example. Note that a solid line denoted by the reference sign T indicates a transport path of the document G. The transport path T is formed in a space sandwiched by the lower unit 13 and the upper unit 14.

The document feeding device 30 is an example of the medium feeding device. In addition, the document feeding device 30 includes, as main parts, the document placement unit 31, a feeding roller 32, a separation roller 33, a ranging sensor 34, a placement unit sensor 36, an operating panel 37, and a control unit 40.

Figure 4:
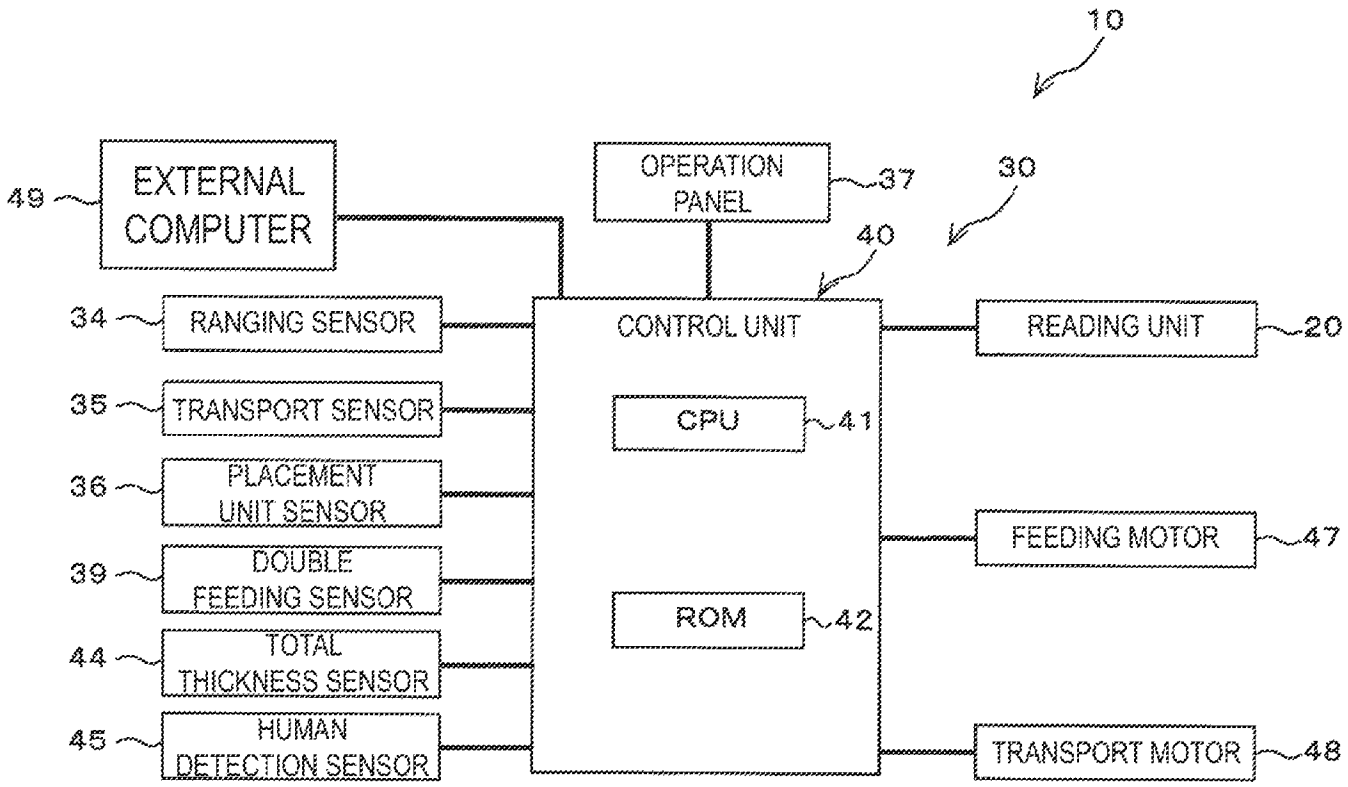
FIG. 4 is a block diagram illustrating a control system of the scanner according to the first exemplary embodiment.

As illustrated in FIG. 4, the document feeding device 30 further includes a transport sensor 35, a plurality of transport roller pairs 38 (FIG. 2), a double feeding sensor 39, a total thickness sensor 44, a human detection sensor 45, a feeding motor 47, and a transport motor 48.

Figure 3:
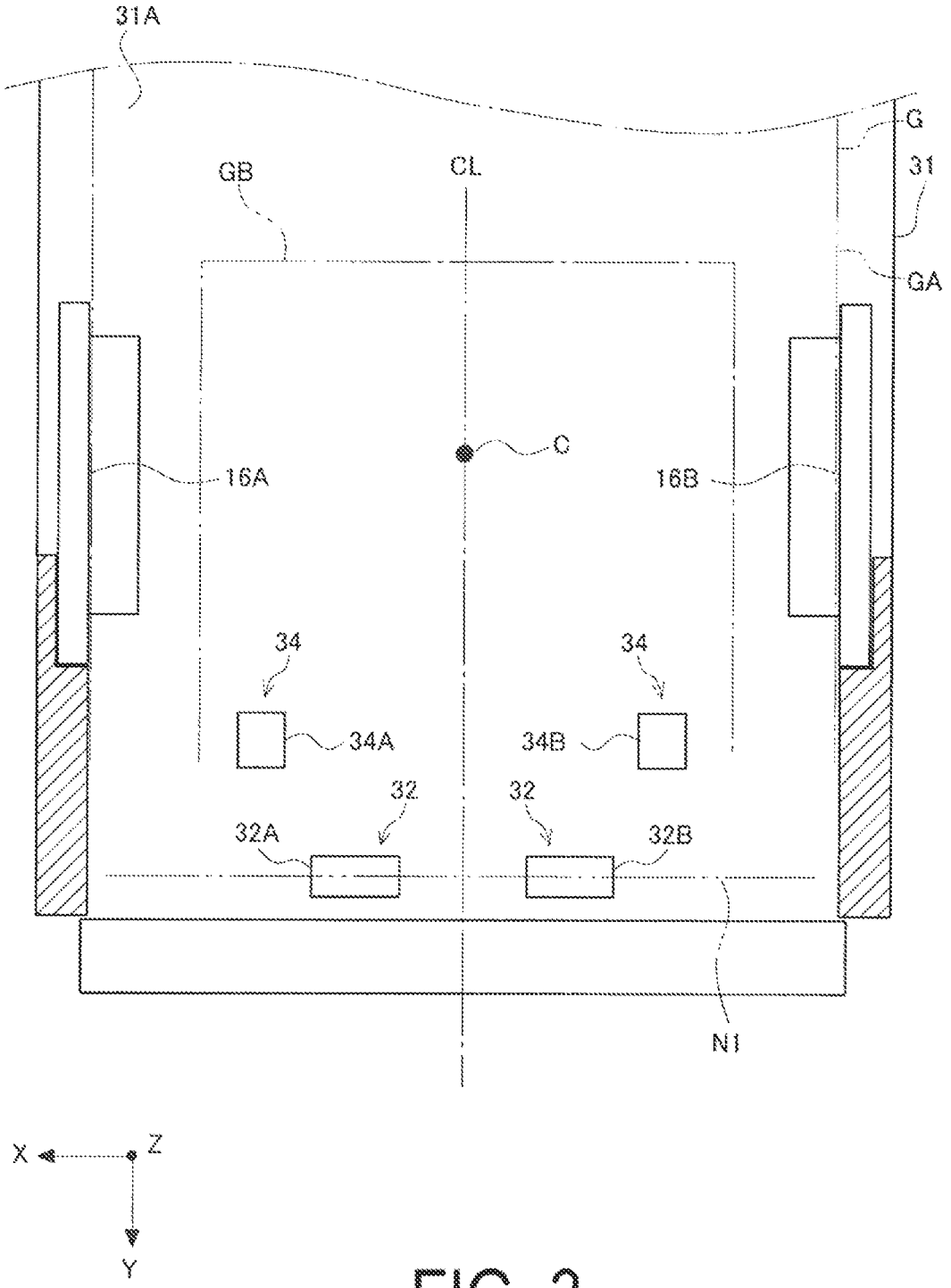
FIG. 3 is a plan view of the document transport path of the scanner according to the first exemplary embodiment.

As illustrated in FIG. 2, the document placement unit 31 is an example of a placement unit, and is formed in a plate shape having a predetermined thickness in the Z direction. The document placement unit 31 extends in the Y direction. In addition, the document placement unit 31 has a placement surface 31A on which the document G to be fed is placed. Edge guides 16A, 16B, which guide the side edges in a width direction of the placed document G, are provided on the document placement unit 31. The edge guides 16A, 16B are provided so as to be displaceable in the X direction. Note that, in the placement surface 31A, a position centered in the X direction and the Y direction is referred to as a center point C (FIG. 3). Further, a virtual line extending in the Y direction through the center point C is referred to as a center line CL (FIG. 3).

The feeding roller 32 is an example of a feeding unit, and feeds the documents G placed on the document placement unit 31 one by one. Note that the feeding roller 32 contacts the document G located most downward among the documents G placed on the placement surface 31A. Accordingly, when a plurality of the documents G are set in the scanner 10 in the document placement unit 31, the document G, which is in contact with the placement surface 31A, is fed downstream in order. In this manner, the feeding roller 32 feeds the document G located most downward among the plurality of documents G placed on the document placement unit 31. The manner in which the document is fed sequentially from the lower document G is referred to as a lower feeding method.

As illustrated in FIG. 3, the feeding roller 32 is arranged so as to be linearly symmetrical with respect to the center line CL, and has a feeding roller 32A in the +X direction and a feeding roller 32B in the −X direction. The feeding roller 32 is driven to rotate by the feeding motor 47 (FIG. 4) to feed the document G downstream.

The transport roller pair 38 is provided downstream of the feeding roller 32 in the Y direction. The separation roller 33 (FIG. 2) includes two rollers arranged linearly symmetrically in the X-direction similar to the feeding roller 32, which faces the feeding rollers 32A, 32B in the Z direction. Note that in FIG. 3, a virtual line N1 indicates a nip position of the document G by the feeding roller 32 and the separation roller 33.

In addition, the separation roller 33 is driven to rotate by a motor (not illustrated) during the feeding operation of the document G, so as to prevent double feeding of the document G.

As illustrated in FIG. 2, the transport sensor 35 is configured as an optical sensor including, as an example, a light emitting unit 35A configured to emit detection light, and a light receiving unit 35B capable of receiving the detection light. The light emitting unit and the light receiving unit are provided sandwiching the transport path T. The control unit 40 (refer to FIG. 4) can detect the passage of a tip or a rear end of the document P at a detection position based on a detection signal received from the transport sensor 35.

The plurality of transport roller pairs 38 transport the document G fed by the feeding roller 32 along the transport path T.

The double feeding sensor 39 (FIG. 4) is an ultrasonic sensor, as an example, and includes an emitting unit 39A that emits ultrasonic waves and a reception unit 39B capable of receiving the ultrasonic waves. The light emitting unit and the light receiving unit are provided sandwiching the transport path T. The control unit 40 (refer to FIG. 4) can detect the double feeding of the document at a detection position based on a detection signal received from the double feeding sensor 39.

The ranging sensor 34 is an example of a measuring unit. The ranging sensor 34 is provided on the upper unit 14, and is located above the document placement unit 31 in the Z direction. The ranging sensor 34 is configured as an ultrasonic sensor, as an example, and includes a emitting unit (not illustrated) that emits ultrasonic waves and a reception unit (not illustrated) capable of receiving the ultrasonic waves. The emitting unit and the receiving unit are provided at positions facing the uppermost document G among the documents G placed on the document placement unit 31. The emitting unit emits ultrasonic waves toward the document G, and the receiving unit receives the reflected component of the ultrasonic waves reflected by the document G. The control unit 40 (refer to FIG. 4) that receives the detection signal from the ranging sensor 34 can calculate a distance to the document G located most upward in the Z direction among the documents G placed on the document placement unit 31, based on a time required for the transmission to the reception of the ultrasonic waves. Note that, as will be described in detail below, the acquisition of the distance is performed at a plurality of time points.

As illustrated in FIG. 3, the ranging sensor 34 is arranged on one side and the other side of the feeding roller 32 in the X direction as the width direction of the document G when viewed from the Z direction. In other words, the ranging sensor 34 includes a left sensor 34A arranged in the +X direction with respect to the centerline CL and a right sensor 34B arranged in the −X direction with respect to the centerline CL. The configurations and functions of the left sensor 34A and the right sensor 34B are the same.

Here, the distance in the Y direction from the upstream end in the −Y direction of the document placement unit 31 to a measuring position by the ranging sensor 34 is longer than the distance in the Y direction from the downstream end in the +Y direction of the document placement unit 31 to the measuring position by the ranging sensor 34.

In addition, the distance in the Y direction from the upstream end in the −Y direction of the document placement unit 31 to the measuring position by the ranging sensor 34 is longer than the distance in the Y direction from a roller axis (not illustrated) of the feeding roller 32 to the measuring position by the ranging sensor 34.

As an example, the document G with an A3 size is referred to as a document GA, and the document G with an A4 size that is smaller than the A3 size is referred to as a document GB. The left sensor 34A and the right sensor 34B are located above the document placement unit 31 so that the measurement for each of the document GA and the document GB can be performed.

Further, the ranging sensor 34 is arranged downstream from the center point C in the Y direction and upstream with respect to the feeding roller 32, as viewed from the Z direction.

In addition, the document GA may be an A4 size, and the document GB may be an A5 size. As long as the relationship is that the document GA has a size larger than the document GB, any other document size can be used.

The placement unit sensor 36 illustrated in FIG. 4 is an example of a medium detecting unit. The control unit 40 (refer to FIG. 4) detects the presence or absence of the document G based on a detection signal from the placement unit sensor 36. In other words, the placement unit sensor 36 is a sensor for detecting whether the document G is placed on the document placement unit 31. The placement unit sensor 36 includes a reflective optical sensor, as an example. When the document G is placed on the document placement unit 31, the placement unit sensor 36 outputs a high level detection signal to the control unit 40. When the document G is not placed on the document placement unit 31, the placement unit sensor 36 outputs a low level detection signal to the control unit 40.

The operation panel 37 is an example of an input unit. In addition, the operating panel 37 includes a touch panel as an example, which allows for operating various read settings and reading executions on the scanner 10, etc. In the operating panel 37, an automatic feed mode can be selected as a mode for reading the document G. Hereinafter, the automatic feeding mode is referred to as a "standby mode" for convenience. More specifically, during a mode other than the standby mode, the control unit 40 (refer to FIG. 4) starts rotating the feeding roller 32 only when receiving a scan start instruction via an external computer 49 (refer to FIG. 4) coupled to the operating panel 37 or the scanner 10.

On the other hand, during the standby mode, in a case where the control unit 40 determines that the document G on the document placement unit 31 has been absent based on the detection signal of the placement unit sensor 36, i.e., in a case where the currently fed document G is determined to be the last document, the control unit 40 stops rotating the feeding roller 32 once the feeding of the document G has ended, and waits for the document G to be placed on the document placement unit 31. Then, when it is determined that the document G is placed on the document placement unit 31 based on the detection signal from the placement unit sensor 36, the rotation of the feeding roller 32 is resumed and the document G is fed. In other words, during the standby mode, automatic feeding is performed once the document G is placed on the document placement unit 31, and the user does not need to perform the scan start instruction each time the document G is placed on the document placement unit 31.

As illustrated in FIG. 4, the control unit 40 includes a CPU 41 and a flash ROM 42. The CPU 41 performs various arithmetic processing in accordance with programs stored in the flash ROM 42 to control the operation of the entire scanner 10. Specifically, the control unit 40 performs various controls of the scanner 10, including feeding the document G, transporting the document G, ejecting the document G, and reading the reading unit 20. Various configuration information input by the user via the operation panel 37 is stored in the flash ROM 42.

The control unit 40 is configured to be connectable to the external computer 49. Various types of information are input from the external computer 49.

The control unit 40 controls the feeding motor 47 and the transport motor 48. The feeding motor 47 is a drive source of the feeding roller 32. The transport motor 48 is a drive source of the separation roller 33 and the plurality of transport roller pairs 38 (refer to FIG. 2). Both the feeding motor 47 and the transport motor 48 are DC motors.

Read data from the reading unit 20 is input to the control unit 40. A signal for controlling the reading unit 20 is transmitted from the control unit 40 to the reading unit 20.

Further, signals from the ranging sensor 34, the transport sensor 35, the placement unit sensor 36, the double feeding sensor 39, the total thickness sensor 44, and the human detection sensor 45 are also input to the control unit 40.

The total thickness sensor 44 is an example of a total thickness measurement unit, and is provided in the upper unit 14 (FIG. 2). The total thickness sensor 44 is a sensor for measuring the total thickness of the documents G before feeding placed on the document placement unit 31. In a case of a single document G, the total thickness of the documents G refers to the thickness of the document G itself. In a case of a plurality of documents G, it means the overall thickness of the stacked documents G, i.e. the thickness of the document bundle.

When measuring the total thickness of the documents G, the ranging sensor 34 may be used as a total thickness sensor.

In addition, the total thickness sensor 44 may be configured as a sensor using optical triangular ranging principles used for autofocus cameras etc. Although not illustrated in the drawings, the total thickness sensor 44 irradiates the document G with light, receives the reflected light from the document G by a light receiving element, and measures the total thickness (mm) in the Z direction of the document G placed on the document placement unit 31 based on the amount of movement of the spot in the light receiving element.

The human detection sensor 45 is an example of an operation detecting unit, and is provided on an outer packaging cover of the lower unit 13. The human detection sensor 45 is configured as an infrared sensor as an example, and detects the presence of a user around the scanner 10 by detecting infrared radiation emitted from the user.

when it can be determined that the user is present in the vicinity of the scanner 10, it can be determined that there is a high possibility of performing additional operation for adding an additional document G to the document G placed on the document placement unit 31, in other words, a joint operation of the document G.

Note that, as will be described in detail below, a detection result of the human detection sensor 45 is used by the control unit 40 when the feeding of the document G is performed. This is because there is no problem when the user is present in the vicinity of the scanner 10 when the document G is not fed. However, when the user is detected by the human detection sensor 45 during a power saving mode, for example, the power saving mode may be released.

Other methods of the human detection sensor 45 include a capacitive method, an optical method, etc., for example.

Figure 5:
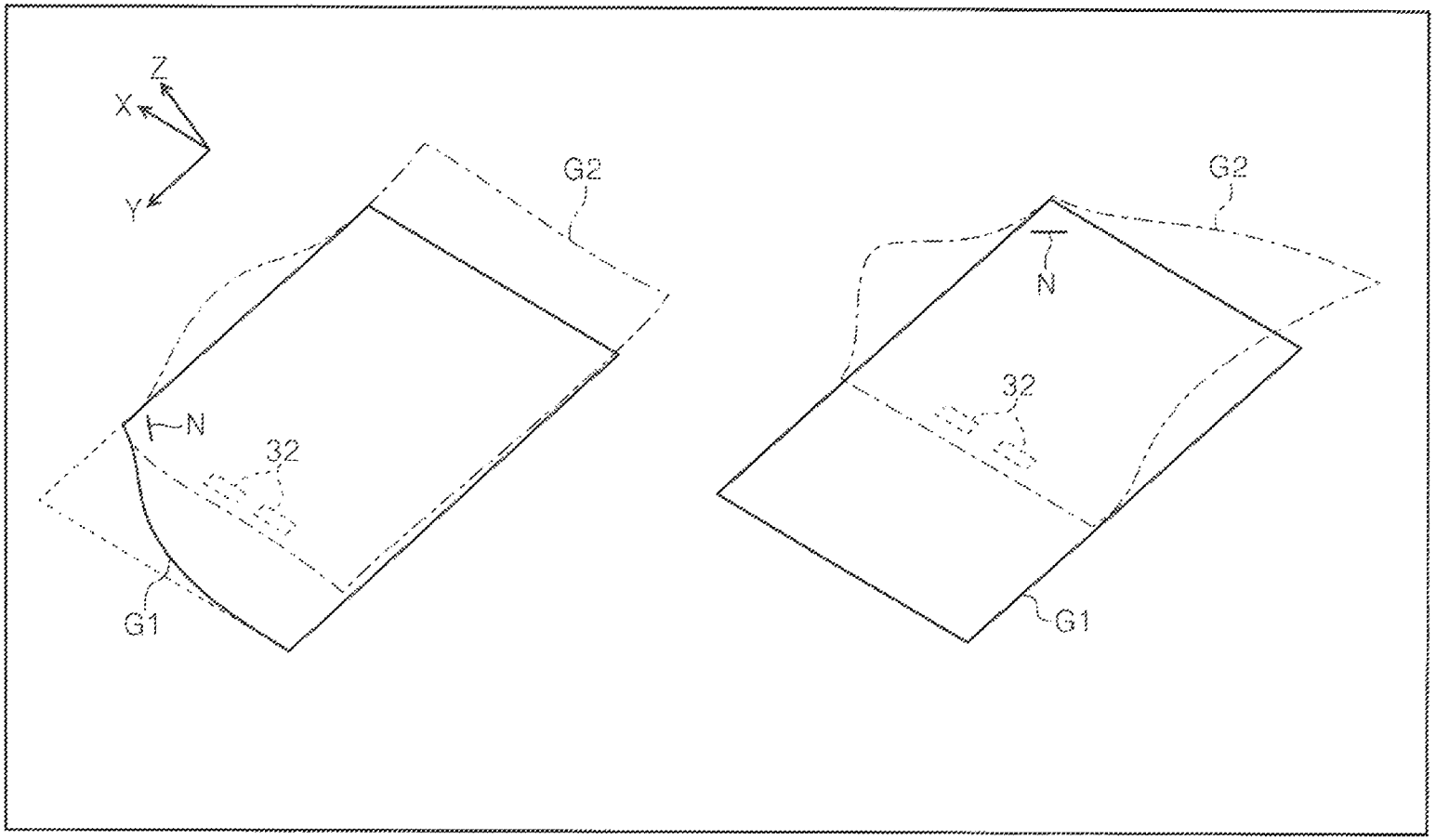
FIG. 5 is a schematic diagram illustrating a phenomenon that may occur when a portion of a partially-bound document is incorrectly fed in a lower feed of a document.

FIG. 5 illustrates an example of a deformation state of documents G1 and G2 in the case where only the lower document G1 is fed among the two documents G1 and G2 with a corner thereof bound by a binding needle N using the lower feeding method. The deformation state of the documents G1 and G2 differs from each other depending on whether the binding needle N is at a corner downstream or at a corner upstream corner in the Y direction. However, in both cases, a portion of the document G2 located on the document G1 to be fed will bulge in the +Z direction. The bulging of the document G2 grows as the feeding of the document G1 advances. Note that regardless of the position of the binding needle N, an amount of deformation in the Z direction tends to increase as moving away from the feeding roller 32 in the X direction, that is, closer to end portions in the X-direction of the documents G1 and G2.

Figure 6:
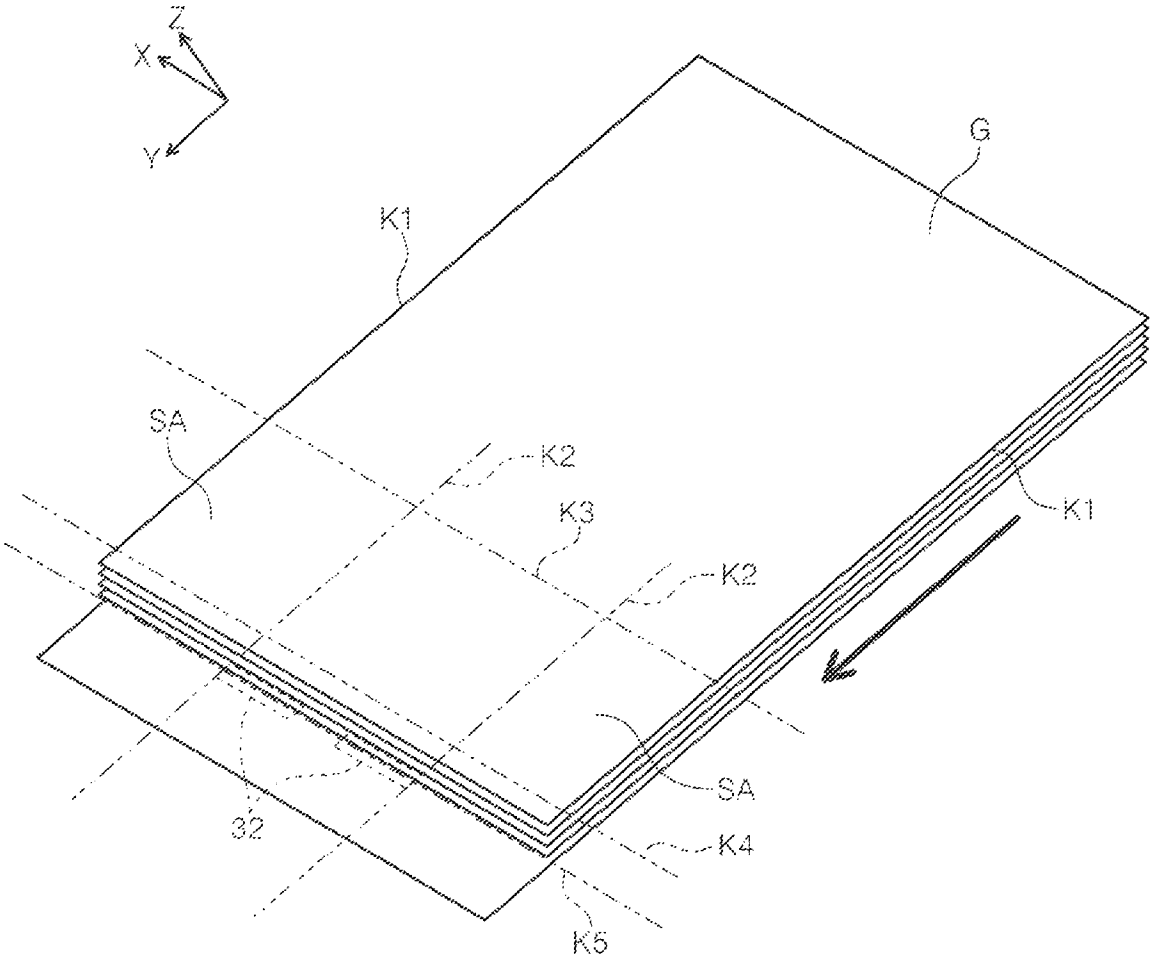
FIG. 6 is a schematic view illustrating a lower feeding state of the document in the scanner according to the first exemplary embodiment.

As illustrated in FIG. 6, lines along the Y direction of the end portions in the X-direction of the document G are referred to as virtual lines K1. In outer end positions in the X direction of the roller portion of the feeding roller 32, lines along the Y direction are virtual lines K2. A line along the X direction through an upstream end position in the Y direction of the document GB (FIG. 3) described above is a virtual line K3. A line along the X direction through a downstream end position in the Y direction of the document G loaded on the document placement unit 31 is a virtual line K4. A line along the X direction through the center of rotation of the feeding roller 32 is a virtual line K5.

Here, the regions surrounded by the virtual lines K1, K2, K3, and K5 are referred to as regions SA. The regions SA are arranged symmetrically in the X direction with respect to the center line CL (FIG. 3) described above as viewed from the Z direction.

The ranging sensor 34 (FIG. 3) is preferably located in the regions SA as viewed from the Z direction. More preferably, the ranging sensor 34 is preferably located within the regions SA and in a location where it can face the document GB.

Figure 7:
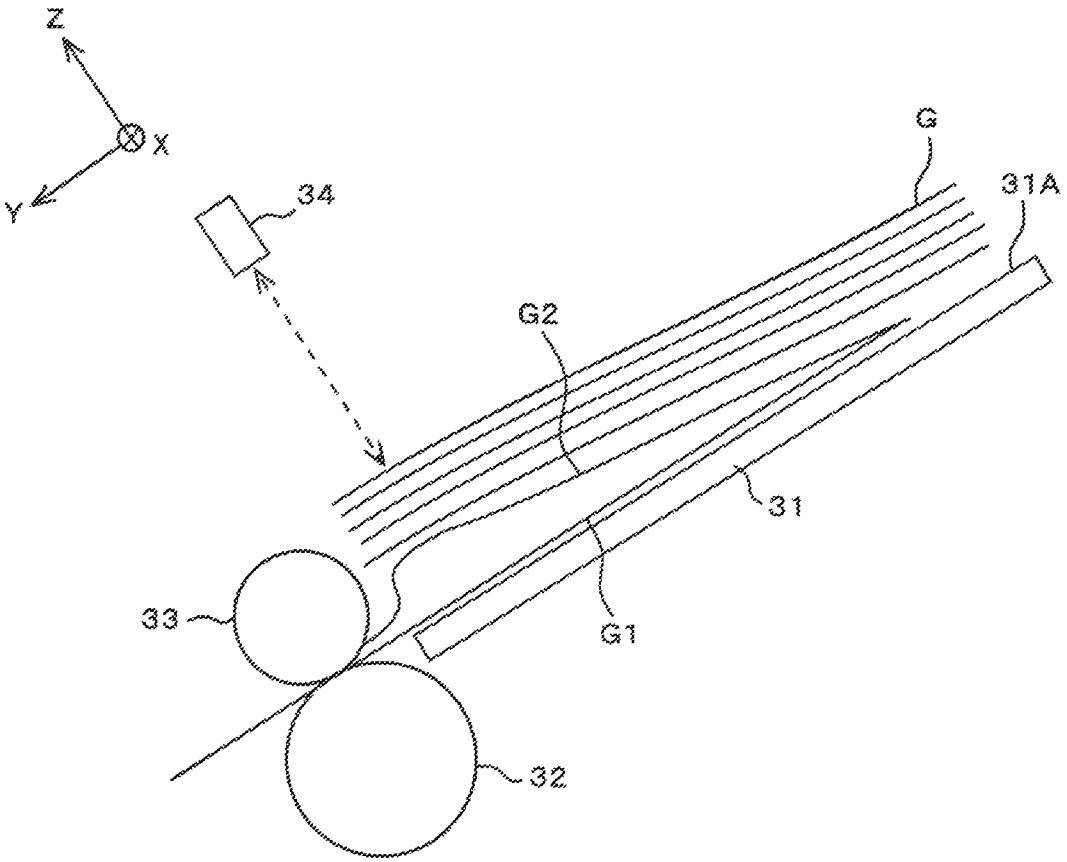
FIG. 7 is a schematic diagram illustrating a measurement state of a distance to the document in the scanner according to the first exemplary embodiment.

As illustrated in FIG. 7, it is assumed that the document G1 located on the document placement unit 31 and located most downward in the Z direction, and the document G2 located immediately above the documents G1, are bound to each other. In addition, the third and subsequent documents G are not bound.

Here, when the documents G are fed by the feeding roller 32, the lowest document G1 is fed.

Since the second document G2 is bound to the lowest document G1, the second document G2 is pulled and fed by the lowest document G1. However, because the feeding is suppressed due to contact with the separation roller 33, the second document G2 is deformed in the Z direction. Due to this deformation, the third or more of the documents G are lifted in the Z direction, and the position in the Z direction of the document G located most upward changes. This change is measured as a change in the distance detectable using the ranging sensor 34.

Figure 8:
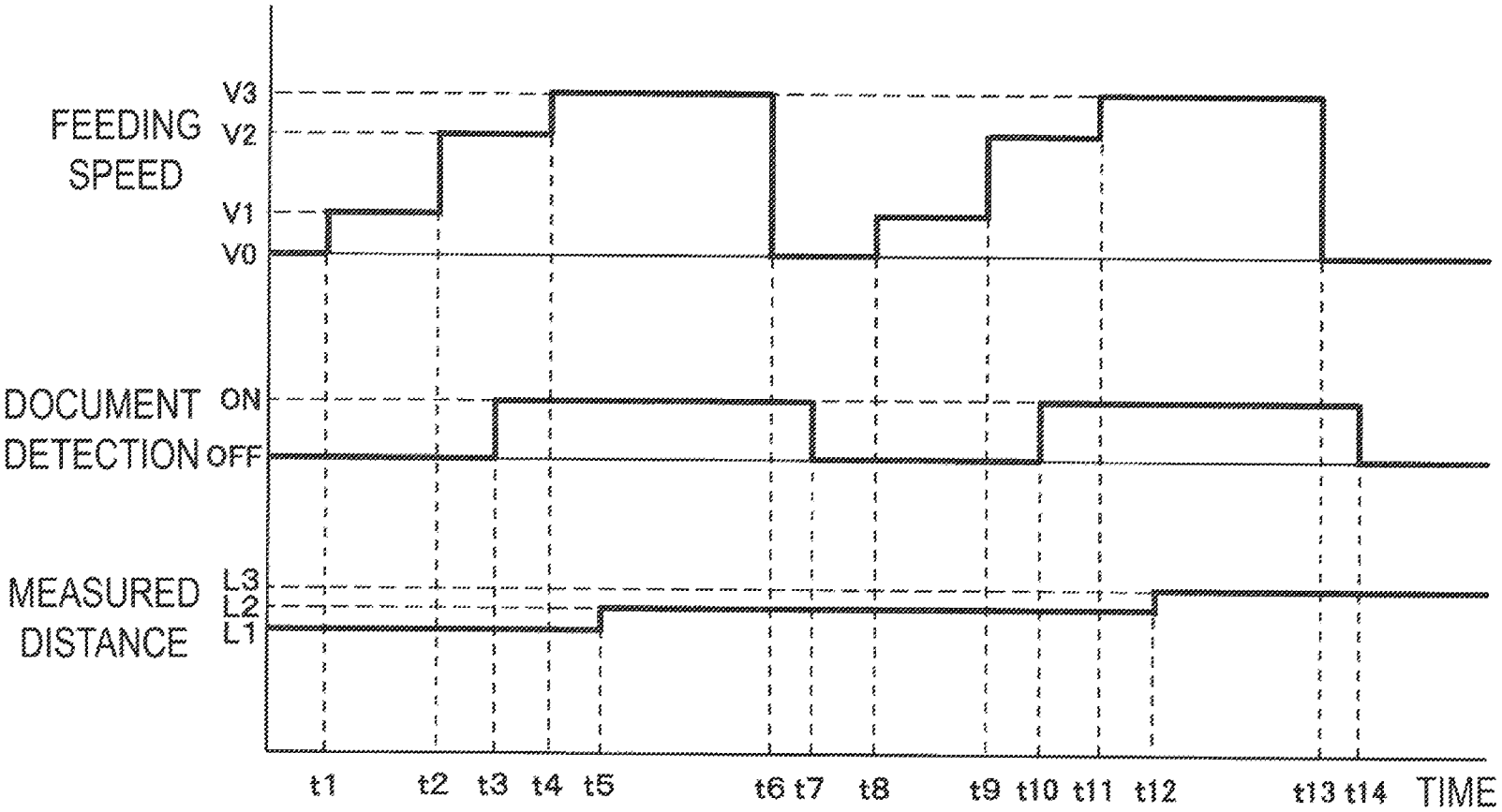
FIG. 8 is a timing chart illustrating the switching of feeding speed, a document detection result, and a measured distance in the scanner according to the first exemplary embodiment.

FIG. 8 illustrates a timing chart of feeding speed of the document G at each time point including the time point t1 to the time point t14, the presence/absence of the detection of the document G in the transport sensor 35, and the measured distance by the ranging sensor 34. From the time point t1 to the time point t14, the time points mean that the number is at a later time as the number increases. The time intervals at each time point are not constant.

The feeding speed changes from speed V0 to speed V1 at the time points t1 t8, from speed V1 to speed V2 at the time points t2, t9, from speed V2 to speed V3 at the time points t4, t11, and from speed V3 to speed V0 at the time points t6, t13, where V0<V1<V2<V3.

With regard to the detection of the document G by the transport sensor 35, it is determined that the document G has been present (ON) at the time point t3 to the time point t7 and from the time point t10 to the time point t14. Until at the time point t3 and from the time point t7 to the time point t10, it is determined that the document G is absent (OFF).

The measured distance from the ranging sensor 34 is a distance L1 until the time point t5, a distance L2 from the time point t5 to the time point t12, and a distance L3 after the time point t12, where L1<L2<L3.

When the feeding abnormality does not occur, the measured distance by the ranging sensor 34 increases gradually each time one sheet of the document G is fed as illustrated in FIG. 8. When the feeding abnormality occurs, for example, when bulging in the +Z direction of the document G2 occurs as described with reference to FIG. 5, the measured distance by the ranging sensor 34 decreases continuously from immediately after starting the paper feed.

Various control by the control unit 40 illustrated in FIG. 4 will be described with reference to FIGS. 1 to 4.

The control unit 40 performs distance calculation processing based on the detection signal from the ranging sensor 34 at a constant time interval, for example 10 ms, and acquires a plurality of distance data as time series data. Then, based on the post-processing distance data obtained by statistically processing the time series data, determination processing is performed to determine whether the feeding of the document G by the feeding roller 32 is stopped.

Here, the statistical processing herein refers to a process for obtaining data that reduces noise effects by performing statistical processing on the time series data. Specifically, as an example of the statistical processing, a moving average method can be adopted in which an average value of a certain time interval of the time series data is determined while the interval is shifted. A known simple moving average method, a weighted moving average method, an index moving average method, etc. can be used as the moving average method.

In the present exemplary embodiment, the simple moving average method is used as an example. Further, adopted as the post-processing distance data are first data DA, which is a moving average value of the time series data, and second data DB, which is a moving average value of the time series data over a longer period of time than the first data DA. Since the second data DB is a moving average value over a longer period of time than the first data DA, the graph plotting the second data DB in time series manner results in a more gradual change than the graph plotting the first time data DA in a time series manner.

Then, when the first data DA deviates from the acceptable range obtained by adding a threshold value S to the second data DB, the feeding of the document G by the feeding roller 32 is stopped.

The first data DA, the second data DB, and the threshold value S will be described in detail later with reference to FIG. 10.

The control unit 40 makes the threshold value S when the total thickness of the documents G is at a first thickness smaller than the threshold value S when the total thickness of the documents G is at a second thickness that is thinner than the first thickness.

When the control unit 40 determines that the additional operation of the document G is performed or possibly performed based on the detection signal from the human detection sensor 45, the control unit 40 continues to feed the document G regardless of the result of the measurement by the ranging sensor 34.

When the placement unit sensor 36 detects the document G from a state in which there is no document G on the placement unit 31, the control unit 40 can execute the standby mode for automatically starting the feeding of the document G by the feeding roller 32. During the execution of the standby mode, the post-processing distance data is obtained by statistically processing the time series data of the distance after the feeding roller 32 starts feeding the document G. At a time point after the feeding roller 32 starts feeding the document G, the control unit 40 determines whether the distance measured by the ranging sensor 34 exceeds the threshold value S.

As described above, the control unit 40 performs the statistical processing on the time series data of the distance at a plurality of time points measured in the ranging sensor 34, and determines whether to stop the feeding of the document G by the feeding roller 32 based on the post-processing distance data obtained by the foregoing statistical processing.

Figure 9:
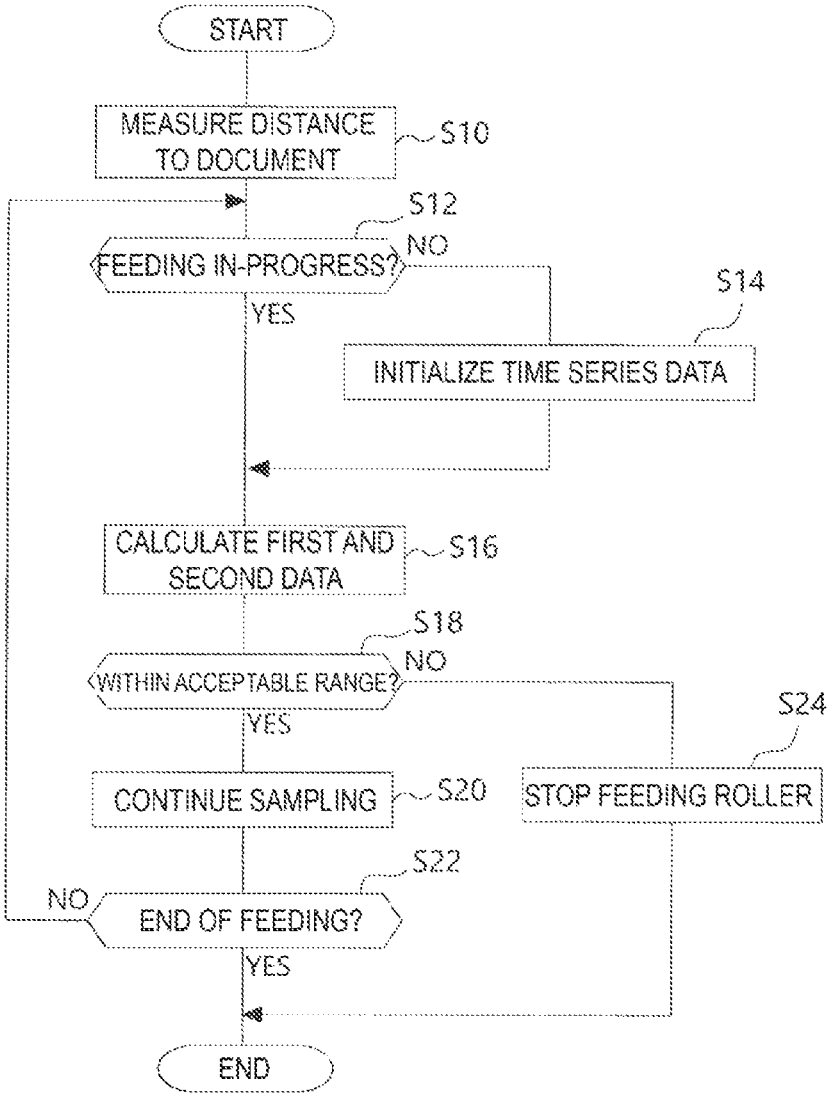
FIG. 9 is a flowchart illustrating the flow of feeding abnormality determination processing in the scanner according to the first exemplary embodiment.

Then, the flow of the determination of the feeding abnormality will be described with reference to FIG. 9. FIG. 9 is a flowchart illustrating the basic flow of the feeding abnormality determination processing in the scanner 10. Each of the processing is performed by the CPU 41 of the control unit 40 that reads a processing program from the flash ROM 42 and executes the program in a RAM (not illustrated).

In step S10, the control unit 40 measures the distance to the document G using the ranging sensor 34. This data is defined as a distance Z. The data of a plurality of distances Z obtained by acquiring the distance Z at a predetermined sampling time interval (e.g., 10 ms) is the time series data. Next, the processing proceeds to step S12.

In step S12, the control unit 40 determines whether the current state is feeding in-progress. Specifically, in the present example, the feeding in-progress means between the time point t1 and the time point t6 in FIG. 8, or between the time point t8 and the time point t13. Also, the non-feeding in-progress means until the time point t1, or between the time point t6 and the time point t8 in FIG. 8.

In a case of the feeding in-progress (S12: YES), the processing moves to step S16.

On the other hand, in a case of the non-feeding in-progress (S12: NO), the control unit 40 moves to step S14.

In step S14, the control unit 40 initializes the time series data of the distance Z obtained at a predetermined sampling time interval (e.g., 10 ms). In other words, when the time series data has been previously obtained, the time series data is discarded, and the time series data is constructed again from the beginning. Next, the processing proceeds to step S16.

In step S16, the control unit 40 acquires the first data DA by moving and averaging the time series data, and acquires the second data DB by moving and averaging the time series data over a longer period of time than the first data DA. The first data DA can be obtained, for example, by simply averaging the values of the most recent four distances Z. The second data DB can be obtained, for example, by simply averaging the values of the most recent 64 distances Z. Next, the processing proceeds to step S18.

In step S18, when the first data DA is within an acceptable range with the second data DB as the center value (S18: YES), the control unit 40 moves to step S20. The acceptable range of the second data DB as the center value is, in the present exemplary embodiment, a range that is not greater than the value obtained by adding the threshold value S to the second data DB (refer to graph Gd in FIG. 10), and is equal to or greater than or equal to the value obtained by subtracting the threshold value S from the second data DB (refer to graph Gc in FIG. 10).

On the other hand, when the first data DA exceeds the acceptable range with the second data DB as the center value, the control unit 40 determines that abnormal feeding has been performed, and stops feeding of the document G by the feeding roller 32. The program then ends.

In step S20, the control unit 40 continues sampling the distance Z. Next, the processing proceeds to step S22.

In step S22, the control unit 40 determines whether the feeding of the document G has ended. In a mode other than the standby mode described above, when the document G is absent in the document placement unit 31, the feeding of the document G has ended. In addition, during the standby mode described above, when the user instructs the end of the standby mode, the feeding of the document G has ended.

When the feeding is continued (S22: NO), the control unit 40 moves to step S12. When the feeding is complete (S22: YES), the control unit 40 ends the program. In this manner, the feeding abnormality determination of the document G in the scanner 10 is performed.

Figure 10:
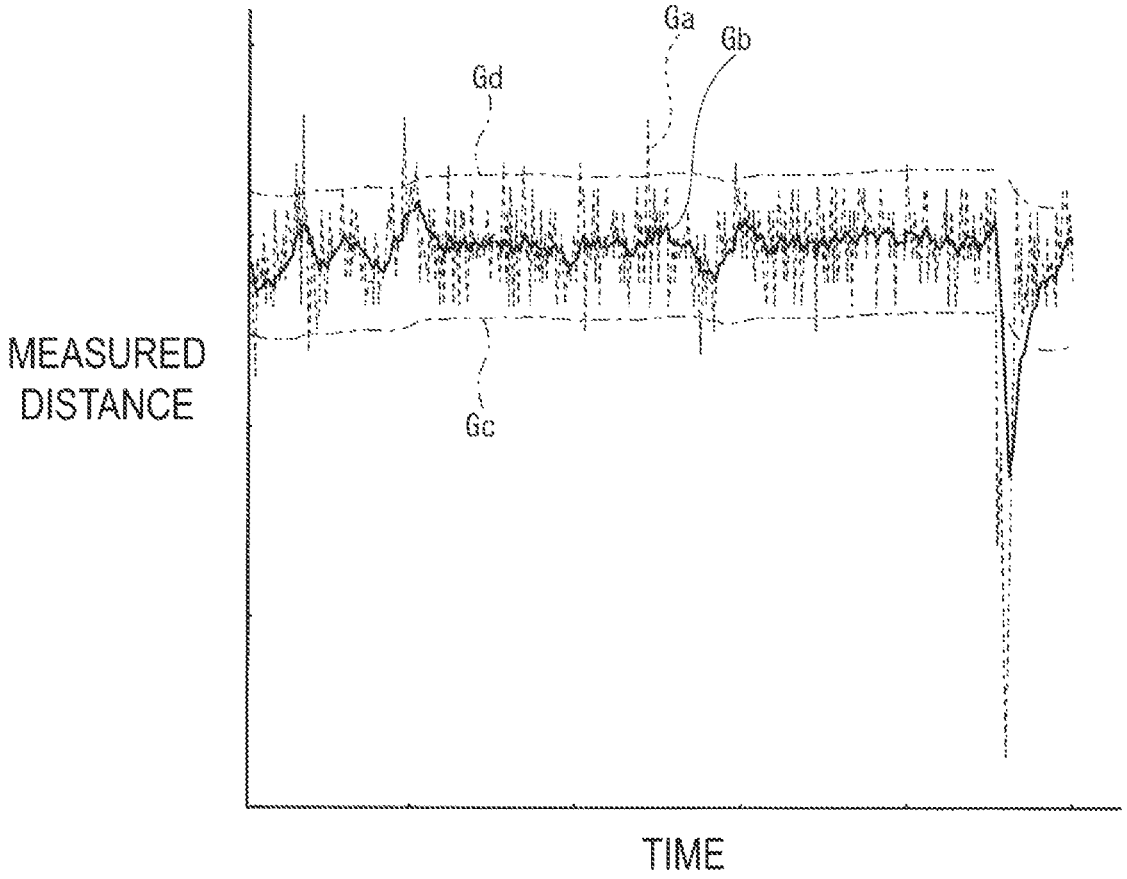
FIG. 10 is a graph illustrating a relationship between a time and a detected distance obtained by a ranging sensor in the scanner according to the first exemplary embodiment.

FIG. 10 illustrates graphs Ga, Gb, Gc, Gd illustrating a relationship between the time and the measured distance, as an example.

The graph Ga represents the time series data of unprocessed raw data, i.e., the distance Z.

The graph Gb represents the first data DA, i.e., a short-term moving average.

The graph Gc represents a value obtained by subtracting the threshold value S from the second data DB, i.e., a long term moving average. That is, the graph Gc represents the lower limit of the acceptable range.

The graph Gd represents a value obtained by adding the threshold value S to the second data DB, i.e., a long term moving average. That is, the graph Gc represents the upper limit of the acceptable range.

Here, in the present exemplary embodiment, when the first data DA exceeds the set range between the graph Gc and the graph Gd, the feeding roller 32 is stopped.

Figure 11:
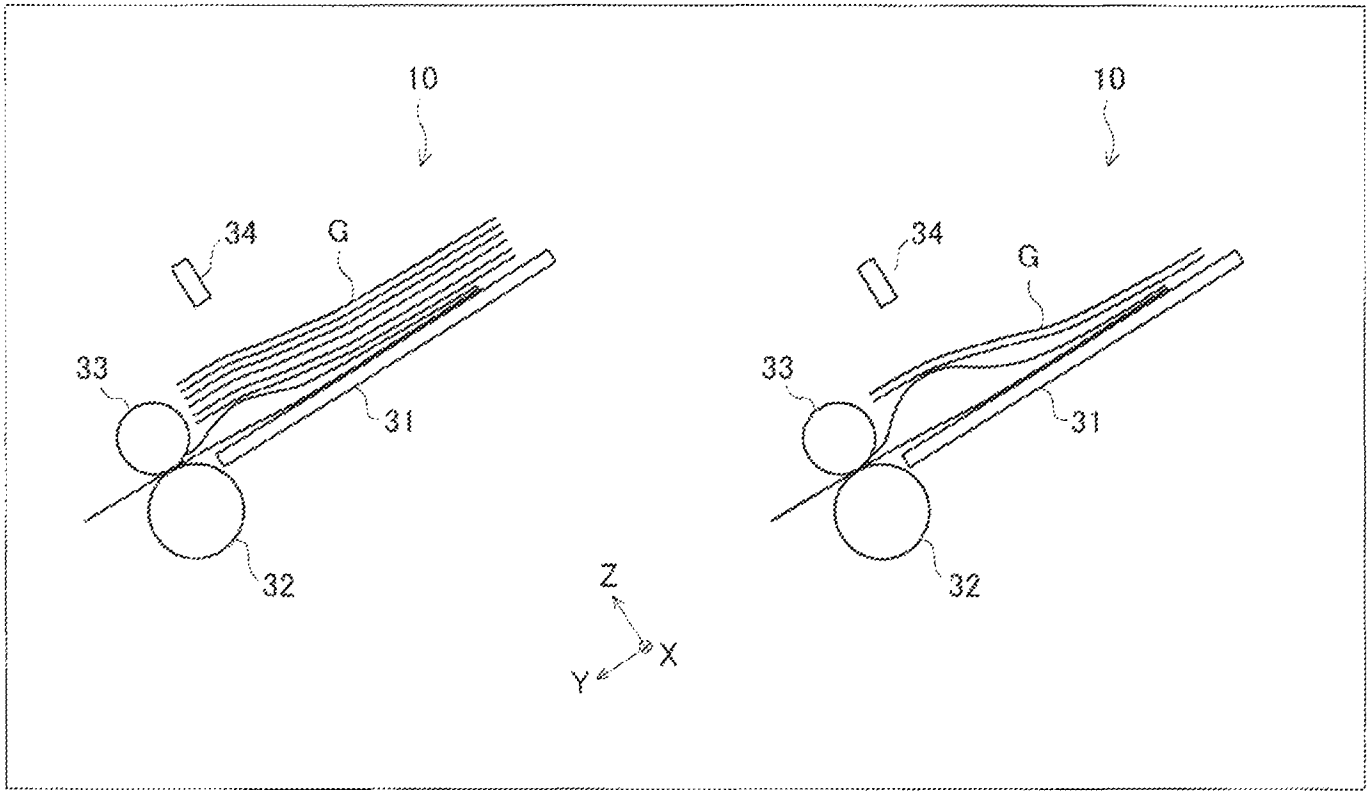
FIG. 11 is a schematic diagram illustrating a state of distance measurement when a loading amount of the document in the scanner is changed according to the first exemplary embodiment.

As illustrated in the left view of FIG. 11, in the scanner 10, the threshold value S is referred to as a threshold value S1 (not illustrated) for the case where the number of the stacked documents G on the document placement unit 31 is large and the document height before and after the start of feeding by the feeding roller 32 is high, i.e., for the case where the total thickness of the documents G is thick. Further, as illustrated in the right view of FIG. 11, in the scanner 10, the threshold value S is referred to as a threshold value S2 (not illustrated) for the case where the number of the stacked documents G on the document placement unit 31 is small, and the document height before and after the start of feeding by the feeding roller 32 is low, i.e., for the case where the total thickness of the documents G is thin. Then, the control unit 40 sets the threshold value S1 to be smaller than the threshold value S2. This is because, when the total thickness of the documents G is thick, the floating of the documents G becomes smaller when the feeding abnormality occurs compared to a case where the total thickness is relatively thinner. Thus, by reducing the threshold value S and increasing the sensitivity of the abnormality determination, a feeding failure is easily detected.

As described above, according to the document feeding device 30, the document G is placed on the document placement unit 31. The ranging sensor 34 measures, at the plurality of time points, the distance to the document G located most upward. The feeding roller 32 feeds the document G placed on the document placement unit 31 by being controlled by the control unit 40.

Here, the control unit 40 acquires the plurality of distance data as the time series data by the ranging sensor 34. When the post-processing distance data obtained by statistically processing the time series data deviates from the acceptable range, the control unit 40 stops feeding the document G by the feeding roller 32. As a result, it is less likely to be affected by an error factor that occurs accidentally as compared to a configuration in which the feeding of the document G is stopped based on the distance data at one time point. As a result, an erroneous determination is less likely to occur, and in addition, the possibility of stopping feeding can be suppressed even though the feeding of the document G does not need to be stopped.

According to the document feeding device 30, compared to a configuration in which the ranging sensor 34 is not located upward in the Z direction, the distance between the document G placed on the document placement unit 31 and the ranging sensor 34 is reduced. Therefore, a decrease in measuring accuracy of the distance measured by the ranging sensor 34 can be suppressed.

Further, according to the document feeding device 30, even in a case where one portion of the document G with respect to the center line CL in the X direction and the other portion of the document G are in different deformation states when the document G is fed, the variation in the deformation states is measured by one side ranging sensor 34 and the other side ranging sensor 34. Therefore, the feeding state of the document G can be measured accurately.

According to the document feeding device 30, the ranging sensor 34 performs measurement at a location near the feeding roller 32 where the deformation state of the document G is relatively significant. Therefore, the feeding of the document G can be stopped at an earlier time point as compared to a case where the measurement is performed at a location remote from the feeding roller 32.

In addition, according to the document feeding device 30, by using the first data DA that is the moving average value of the time series data and the second data DB that is the moving average value of the time series data over a longer period of time than the first data DA, when the first data DA deviates from the acceptable range obtained by adding the threshold value S to the second data DB, the feeding the document G by the feeding unit is stopped. Therefore, the feeding abnormality can be determined accurately.

In a configuration in which the document G located most downward is fed, the larger the number of the documents G loaded in the document placement unit 31, i.e., the thicker the total thickness of the documents G, the less likely it is to discover the feeding abnormality. Here, according to the document feeding device 30, the thicker the total thickness, the smaller the threshold value S, and more specifically the smaller the absolute value of the threshold value S. In other words, the sensitivity of abnormal discovery is increased in situations where it is difficult to discover the feeding abnormality. As a result, the feeding abnormality can be determined appropriately.

In a configuration in which the feeding roller 32 feeds the document G located most downward, it can be said that the configuration makes it easy for a user to perform the additional operation to add a document G onto a medium G placed on the document placement unit 3, in other words, a joint operation of the document G. Therefore, with such a configuration, errors in measuring the distance can easily occur. Here, according to the document feeding device 30, in a case where it is determined that the additional operation is performed or the additional operation is possibly performed based on the detection information from the human detection sensor 45, the feeding of the document G is continued regardless of the result of the measurement by the ranging sensor 34. This can suppress the accidental stop of the feeding of the document G due to the erroneous measurement of the fluctuation in the distance Z caused by the additional operation as the deformation of the document G.

According to the document feeding device 30, only the measurement results of the ranging sensor 34 when the document G is placed on the document placement unit 31 is used for the determination of the stop of the feeding of the document G, whereby an erroneous determination whether the distance measured by the ranging sensor 34 exceeds the threshold value S can be suppressed. In addition, according to the document feeding device 30, the measurement result of the ranging sensor 34 when the document G is not placed on the document placement unit 31 is prevented from being used for the determination of the stop of the feeding of the document G, whereby an erroneous determination whether the distance measured by the ranging sensor 34 exceeds the threshold value S can be suppressed.

In addition, according to the document feeding device 30, the automatic feeding mode or the standby mode can be executed. Further, during the execution of the standby mode, the post-processing distance data is obtained by statistically processing the time series data of the distance after starting the feeding of the document G. Therefore, the determination of the feeding abnormality can be performed more correctly.

According to the scanner 10, the action and effect of any of the above-described document feeding devices 30 can be obtained.

The document feeding method as one example of the medium feeding method includes a step of obtaining the post-processing distance data by statistically processing the time series data of the distance by the ranging sensor 34 (step S16 in FIG. 9) and a step of determining whether to stop the feeding of the document G by the feeding roller 32 based on the post-processing distance data (step S18). Therefore, it is less likely to be affected by an error factor that occurs accidentally as compared to a configuration in which the feeding of the document G is stopped based on the distance data at one time point. As a result, an erroneous determination is less likely to occur, and in addition, the possibility of stopping feeding can be suppressed even though the feeding of the document G does not need to be stopped.

Second Exemplary Embodiment

Hereinafter, a second exemplary embodiment of a medium feeding device, an image reading device, and a medium feeding method according to the present disclosure will be described with reference to the accompanying drawings. The identical reference sign as in the scanner 10 is used for the identical configuration as in the scanner 10, and the detailed description will be omitted.

Figure 12:
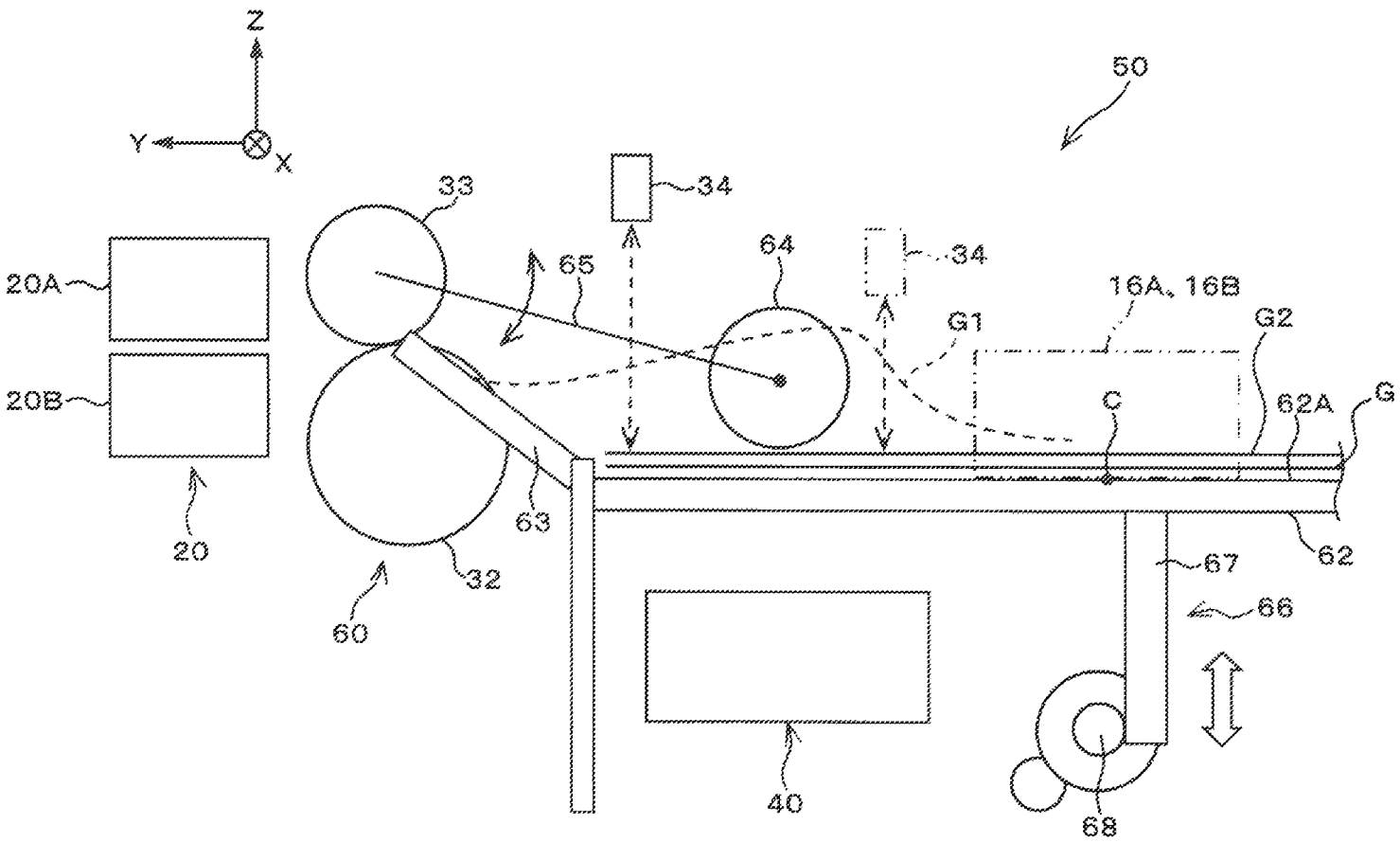
FIG. 12 is a schematic diagram of a scanner according to a second exemplary embodiment.

FIG. 12 illustrates a scanner 50 as an example of the image reading device.

The scanner 50 is configured to be readable on at least one surface of a front surface and a back surface of a document G.

Note that the X-Y-Z coordinate system illustrated in each drawings is an orthogonal coordinate system. The X direction is a device width direction and is a document width direction that intersects with a transport direction of the document G. The Y direction is a document transport direction. Note that in the second exemplary embodiment, the Y direction is along a horizontal plane (not illustrated). The Z direction is a direction orthogonal to the X direction and the Y direction and is a direction orthogonal to the plane of the document G. Additionally, the Z direction is along the vertical plane.

The scanner 50 includes a reading unit 20 and a document feeding device 60 that feeds the document G toward the reading unit 20.

The document feeding device 60 is an example of the medium feeding device. In addition, the document feeding device 60 includes, as main parts, a document placement unit 62, a document guide unit 63, a feeding roller 32, a separation roller 33, a pickup roller 64, an arm member 65, an elevator mechanism unit 66, a ranging sensor 34, a placement unit sensor 36, and a control unit 40. Furthermore, the document feeding device 60 includes a feeding motor (not illustrated).

The document placement unit 62 is an example of a placement unit, and is formed in a plate shape having a predetermined thickness in the Z direction, and extends in the Y direction. In addition, the document placement unit 62 has a placement surface 62A on which the document G to be fed is placed in the −Z direction. Edge guides 16A, 16B, which guide the side edges in a width direction of the placed document G, are provided on the document placement unit 62. Furthermore, the document placement unit 62 can be raised in the +Z direction and lowered in the −Z direction by the elevator mechanism unit 66. Note that, in the placement surface 62A, a position centered in the X direction and the Y direction is referred to as a center point C.

The elevator mechanism unit 66 includes a rack portion 67 provided on a lower surface of the document placement unit 62, and a pinion 68 that raises and lowers the rack portion 67. The pinion 68 is driven by a motor (not illustrated). The drive of the motor (not illustrated) is controlled by the control unit 40.

The document guide unit 63 extends diagonally upward from a position adjacent to an end portion in the +Y direction of the document placement unit 62 toward a nip unit N between the feeding roller 32 and the separation roller 33. Then, the document guide unit 63 guides the document G toward the nip portion N.

The pickup roller 64 is rotatably supported by the arm member 65 with the X direction as the axial direction. An outer circumferential surface of the pickup roller 64 contacts the document G located most upward in the Z-direction.

The arm member 65 is swingably provided with the X direction as the axial direction. As a result, even when the total thickness of the documents G on the document placement unit 62 changes, the pickup roller 64 can contact the document G located most upward.

The feeding roller 32 contacts the document G located most upward among the documents G placed on the placement surface 62A. Accordingly, when a plurality of the documents G are set in the scanner 50 in the document placement unit 62, the document G located most upward is fed downstream in order. In this manner, the feeding roller 32 feeds the document G located most upward among the plurality of documents G placed on the document placement unit 62. The manner in which the document is fed sequentially from the upper document G is referred to as an upper feeding method.

Figure 13:
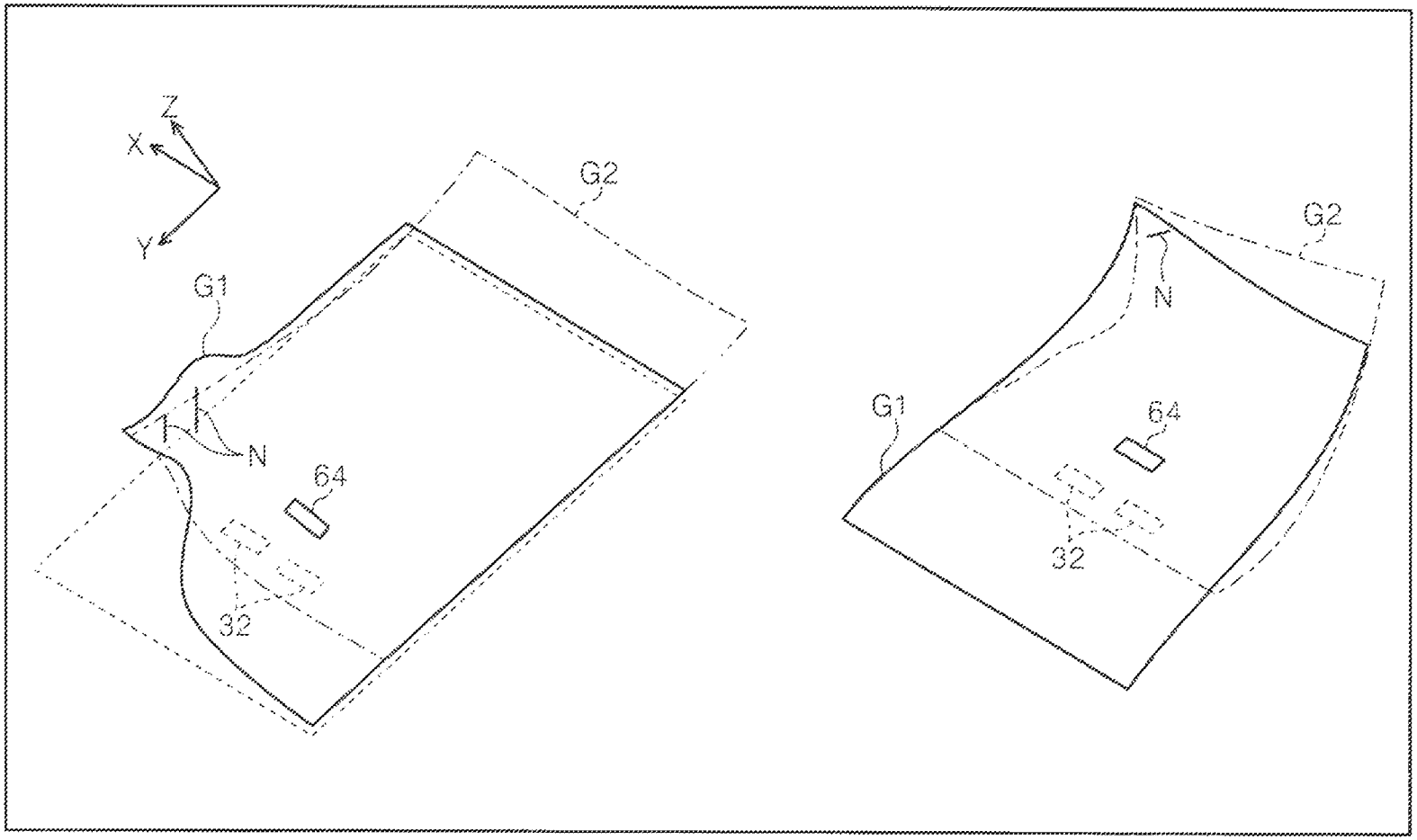
FIG. 13 is a schematic diagram illustrating a phenomenon that may occur when a portion of a partially-bound document is incorrectly fed in an upper feed of a document.

FIG. 13 illustrates an example of a deformation state of documents G1 and G2 in the case where, among the two documents G1 and G2 with a corner thereof bound by a binding needle N, only the upper document G1 is fed in the upper feeding method. The deformation state of the documents G1 and G2 differs from each other depending on whether the binding needle N is at a corner downstream or at a corner upstream corner in the Y direction, but in both cases, a portion of the document G1 to be fed will bulge in the +Z direction. The bulging of the document G1 grows as the feeding proceeds. Note that regardless of the position of the binding needle N, an amount of deformation in the Z direction tends to increase as moving away from the feeding roller 32 and the pickup roller 64 in the X direction, that is, closer to end portions in the X-direction of the documents G1 and G2.

Figure 14:
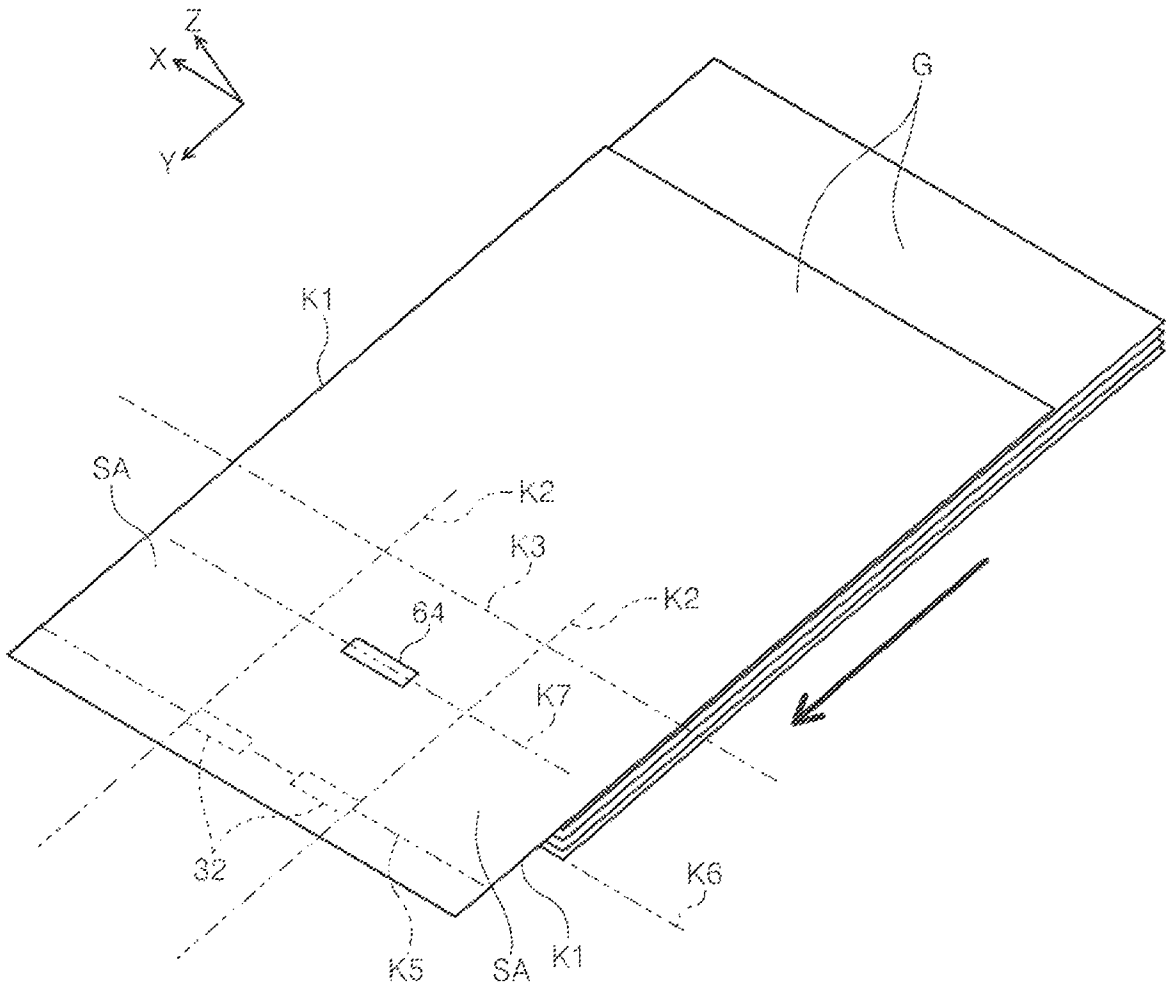
FIG. 14 is a schematic view illustrating an upper feeding state of the document in the scanner according to the second exemplary embodiment.

As illustrated in FIG. 14, a line along the X direction through a downstream end position in the Y direction of the document G loaded on the document placement unit 62 (FIG. 12) is a virtual line K6. A line along the X direction through the center of rotation of the pickup roller 64 is a virtual line K7. Here, the ranging sensor 34 (FIG. 12) is preferably located in the regions SA as viewed from the Z direction.

As illustrated in FIG. 12, it is assumed that the document G1 located on the document placement unit 62 and located most upward in the Z direction, and the document G2 located immediately below the documents G1, are bound. In addition, the third and subsequent documents G from the top are not bound. Here, when the documents G are fed by the feeding roller 32, the uppermost document G1 fed by the pickup roller 64 is fed.

Since the second document G2 is bound to the uppermost document G1, the second document G2 is pulled and fed by the uppermost document G1, but the feeding is suppressed due to the frictional force generated by the load received from the pickup roller 64. Thus, as a result, the position in the Z direction of the document G1 located most upward changes. This change is measured as a change in the distance by the ranging sensor 34.

Next, the actions of the scanner 50 and the document feeding device 60 of the second exemplary embodiment will be described with reference to FIGS. 12 to 14. Note that, except for the basic actions, the same actions as the scanner 10 and the document feeding device 30 will be omitted. Furthermore, descriptions of the individual drawing numbers are omitted.

According to the document feeding device 60, the document G is placed on the document placement unit 62. The ranging sensor 34 measures, at the plurality of time points, the distance to the document G located most upward. The pickup roller 64 and the feeding roller 32 feed the document G placed on the document placement unit 62 by being controlled by the control unit 40.

Here, the control unit 40 acquires the plurality of distance data as the time series data by the ranging sensor 34. When the post-processing distance data obtained by statistically processing the time series data deviates from the acceptable range, the control unit 40 stops feeding the document G by the feeding roller 32. As a result, it is less likely to be affected by an error factor that occurs accidentally as compared to a configuration in which the feeding of the document G is stopped based on the distance data at one time point. As a result, an erroneous determination is less likely to occur, and in addition, the possibility of stopping feeding can be suppressed even though the feeding of the document G does not need to be stopped.

According to the scanner 50, the action and effect of the above-described document feeding device 60 can be obtained.

Figure 15:
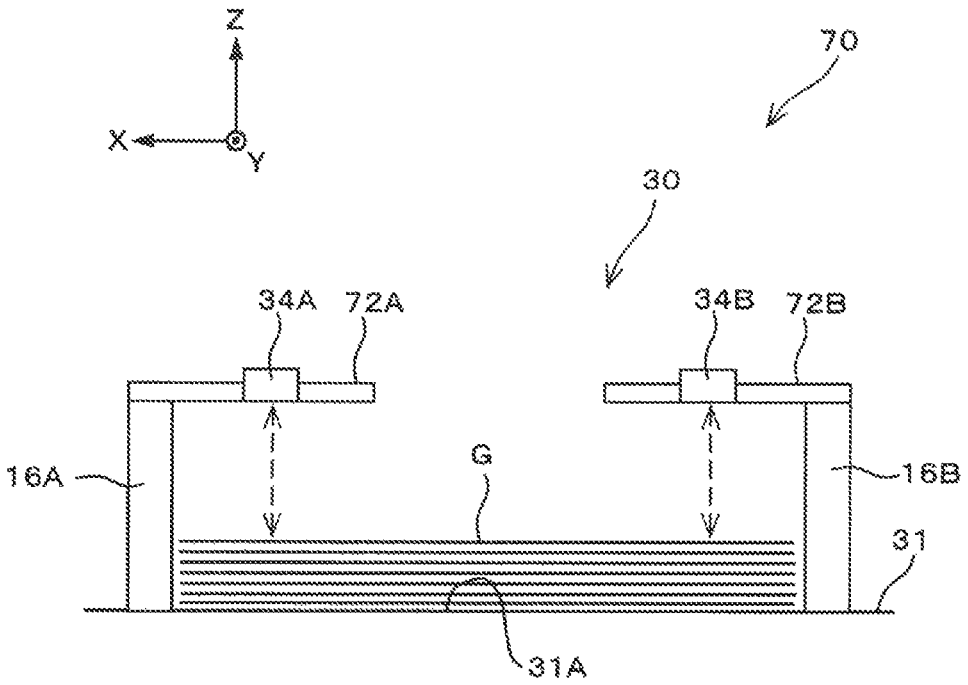
FIG. 15 is a schematic view of a scanner according to a modified example.

A scanner 70, which is a modified example of the first exemplary embodiment, will be described with reference to FIG. 15.

The scanner 70 is an example of an image reading device. Note that the identical reference sign as in the scanner 10 (FIG. 3) is used for the identical configuration as in the scanner 10, and the detailed description will be omitted.

The scanner 70 has a configuration in which the ranging sensor 34 is provided on the edge guides 16A, 16B of the scanner 10. Specifically, arm members 72A, 72B are attached to end portions of the edge guides 16A, 16B in the +Z direction.

The arm member 72A is formed in a plate shape having a predetermined thickness in the Z direction and extends linearly from the edge guide 16A toward the −X direction. A left sensor 34A is attached to a portion of the arm member 72A in the X direction. The left sensor 34A measures the distance to the document G located most upward.

The arm member 72B is formed in a plate shape having a predetermined thickness in the Z direction, and extends linearly from the edge guide 16B toward the +X direction. A right sensor 34B is attached to a portion of the arm member 72B in the X direction. The right sensor 34B measures the distance to the document G located most upward.

By providing the ranging sensor 34 on the edge guide 16A, 16B in this manner, the ranging sensor 34 can be moved in the X direction in accordance with the width in the X direction of the document G, whereby the distance of the relatively large deformation of the document G to the end portion in the X direction can be easily measured.

An example of the medium feeding device and image reading device of the present embodiment is based on the configuration described above. However, as a matter of course, modifications, omission, etc. may be made to a partial configuration without departing from the gist of the disclosure of the present application.

In the document feeding device 30, the ranging sensor 34 may be located at a location other than above the document placement unit 31. In this case, the ranging sensor 34 may measure the distance in the diagonal direction with respect to the document G. Further, the ranging sensor 34 may be provided on only one location or the other location with respect to the center line CL. Further, the ranging sensor 34 may be arranged upstream in the +Y direction with respect to the center point C of the document placement unit 31. Also, the ranging sensor 34 may be arranged downstream from the center point C in the +Y direction and upstream from the pickup roller 64, as illustrated by virtual lines in FIG. 12.

The control unit 40 may smooth the data obtained by the measurement by the statistical processing without using the first data DA and the second data DB to stop the feeding roller 32 when the foregoing data exceeds the acceptable range. In addition, the control unit 40 may determine the stop of the feeding roller 32 with or without the total thickness of the documents G or additional operations.

The control unit 40 may acquire the time series data at the time before the rotation of the feeding roller 32 is started, at the time point when the rotation of the feeding roller 32 is started, or at the time point after the rotation of the feeding roller 32 is started.

The control unit 40 may determine whether the distance measured by the ranging sensor 34 exceeds the threshold value S at a time point later than the time when the rotation of the feeding roller 32 is started and before the time point of the feeding of the document G by the feeding roller 32 is started.

In the above-described exemplary embodiment, as illustrated in FIG. 10, the control unit 40 sets the acceptable range of the first data DA to be a range that is not greater than the value obtained by adding the threshold value S to the second data DB (refer to graph Gd in FIG. 10), and is equal to or greater than or equal to the value obtained by subtracting the threshold value S from the second data DB (refer to graph Gc in FIG. 10). However, for example, the value obtained by adding the threshold value S to the second data DB may not be employed, and a value greater than or equal to the value obtained by subtracting the threshold value S from the second data DB may be used as the acceptable range. This is because the lifting of the document described with reference to FIG. 5 appears as a decrease in the value of the first data DA.

The document feeding device 30 may not have the placement unit sensor 36, the total thickness sensor 44, and the human detection sensor 45.

In addition, in the exemplary embodiment described above, the operation detecting unit is configured by the human detection sensor 45. However, the configuration is not limited thereto, for example, and the operation detecting unit may be configured by a sensor for detecting that the document G is jointed to the document placement unit 31. Such a sensor may be configured by an optical sensor that emits detection light parallel to the X-axis direction at a position higher than the maximum loading height of the document on the document placement unit 31.

Further, the scanner 10 may also include the document feeding device 30 of the above-described modified example.

The placement surface 31A is not limited to a flat surface, and may have unevenness on a portion thereof. Note that when a portion where the unevenness located and a position where the ranging sensor 34 is located are arranged in the Z direction, the amount of displacement of the document G due to the unevenness may be set as the offset value in advance, and the offset value may be added to or subtracted from the distance data obtained.

The ranging sensor 34 may be an optical sensor.

As another example of the statistical processing, the mode and median of the distance data obtained may be determined and used for the determination.

What is claimed is:

1. A medium feeding device comprising:

a placement unit at which media are placed;

a feeding unit configured to feed the media placed at the placement unit;

a measuring unit configured to measure a distance to the medium located most upward in a placement direction among the media placed at the placement unit; and a control unit configured to receive a detection signal output from the measuring unit, and control the feeding of the medium by the feeding unit, wherein the control unit is configured to perform determination processing on whether to stop feeding the medium by the feeding unit based on post-processing distance data obtained by statistically processing time series data of the distance.

2. The medium feeding device according to claim 1, wherein the measuring unit is located upward in the placement direction with respect to the placement unit.

3. The medium feeding device according to claim 1, wherein the measuring unit is arranged on one side and another side of the feeding unit in a width direction of the medium when viewed from the placement direction.

4. The medium feeding device according to claim 1, wherein the measuring unit is arranged downstream from a center of the placement unit in a feeding direction of the medium when viewed from the placement direction.

5. The medium feeding device according to claim 1, wherein the post-processing distance data includes:

first data that is a moving average value of the time series data; and second data that is a moving average value of the time series data over a longer period of time than the first data; and when the first data deviates from an acceptable range based on the second data, the control unit stops feeding the medium by the feeding unit.

6. The medium feeding device according to claim 5, wherein a total thickness measuring unit is provided, the total thickness measuring unit being configured to measure a total thickness of the media before being fed placed at the placement unit;

the feeding unit is configured to feed the medium located most downward among a plurality of the media placed at the placement unit; and the control unit is configured to cause a threshold value when the total thickness of the media is a first thickness to be smaller than the threshold value when the total thickness of the media is a second thickness that is smaller than the first thickness.

7. The medium feeding device according to claim 1, wherein the feeding unit is configured to feed the medium located most downward among a plurality of the media placed at the placement unit;

an operation detecting unit is provided, the operation detecting unit being configured to detect additional operation for adding a medium onto the media placed at the placement unit; and when the control unit determines that the additional operation is performed or the additional operation is possibly performed based on the detection signal of the operation detecting unit, the control unit continues to feed the medium regardless of a result of the measurement by the measuring unit.

8. The medium feeding device according to claim 1, wherein a medium detecting unit is provided to the placement unit, the medium detecting unit being configured to detect the presence or absence of the medium; and the control unit is configured to, upon detecting the medium by the medium detecting unit from a state in which there is no medium at the placement unit, execute an automatic feeding mode for automatically starting the feeding of the medium by the feeding unit, and the control unit is configured to, during the execution of the automatic feeding mode, obtain the post-processing distance data by statistically processing the time series data of the distance after the feeding unit starts feeding the medium.

9. The medium feeding device according to claim 1, wherein a medium detecting unit is provided to the placement unit, the medium detecting unit being configured to detect the presence or absence of the medium; and the control unit is configured to obtain the post-processing distance data by statistically processing the time series data of the distance after the medium detecting unit detects the medium.

10. An image reading device comprising:

a reading unit configured to read a medium; and the medium feeding device according to claim 1, that is configured to feed the medium toward the reading unit.

11. A medium feeding method for a medium feeding device including a placement unit at which media are placed;

a feeding unit configured to feed, one by one, a plurality of the media placed at the placement unit; and a measuring unit configured to measure a distance to the medium located most upward in a placement direction among the media placed at the placement unit, the method comprising:

obtaining post-processing distance data by statistically processing time series data of the distance; and determining whether to stop feeding the medium by the feeding unit based on the post-processing distance data.

* * * * *